US006476790B1

(12) United States Patent
Tanaka

(10) Patent No.: US 6,476,790 B1
(45) Date of Patent: Nov. 5, 2002

(54) DISPLAY DEVICE AND A DRIVER CIRCUIT THEREOF

(75) Inventor: Yukio Tanaka, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 229 days.

(21) Appl. No.: 09/639,973

(22) Filed: Aug. 16, 2000

(30) Foreign Application Priority Data

Aug. 18, 1999 (JP) ..... 11-232048

(51) Int. Cl.[7] ..... G09G 3/36
(52) U.S. Cl. ..... 345/100; 345/98; 345/92
(58) Field of Search ..... 327/333, 334; 326/93, 95; 345/87, 92, 94, 98–100, 204, 205, 211

(56) References Cited

U.S. PATENT DOCUMENTS

| | | | | |
|---|---|---|---|---|
| 5,063,378 | A | * 11/1991 | Roach | 345/90 |
| 5,643,826 | A | 7/1997 | Ohtani et al. | 437/88 |
| 5,923,962 | A | 7/1999 | Ohtani et al. | 438/150 |
| 5,982,348 | A | * 11/1999 | Nakajima et al. | 345/89 |
| 6,157,228 | A | * 12/2000 | Yokoyama et al. | 327/144 |
| 6,157,361 | A | * 12/2000 | Kubota et al. | 326/81 |
| 6,373,460 | B1 | * 4/2002 | Kubota et al. | 326/81 |
| 6,377,235 | B1 | * 4/2002 | Murade et al. | 345/100 |
| 2001/0027507 | A1 | * 10/2001 | Merritt | 711/105 |

FOREIGN PATENT DOCUMENTS

JP 7-130652 5/1995

OTHER PUBLICATIONS

English Abstract re Japanese Patent Application No. JP 7–130652, published May 19, 1995.

* cited by examiner

*Primary Examiner*—Kent Chang
(74) *Attorney, Agent, or Firm*—Cook, Alex, McFarron, Manzo, Cummings & Mehler, Ltd.

(57) ABSTRACT

To provide a driver circuit that is simple and possessing a small surface area. The driver circuit comprises a shift register circuit and a plurality of latch circuits. The shift register circuit is composed of a plurality of register circuits having a clocked inverter circuit and an inverter circuit connected in series. The plurality of digital data latch circuits has a first N-channel Tr and a second N-channel Tr of which the sources or the drains are connected in series, a P-channel Tr, and a data holding circuit. The clocked inverter circuit and the inverter circuit generate a timing signal on the basis of a clock signal and a start pulse to thereby feed the timing signal to the register circuit neighboring a register circuit and to a gate electrode of the first N-channel Tr and the P-channel Tr feeds a first electric voltage to the data holding circuit in accordance with a Res signal inputted to the gate electrode. The second N-channel Tr then takes in digital data on the basis of the timing signal to thereby output the digital data to the source or the drain of the first N-channel Tr. The timing signal outputted from the register circuit neighboring a register circuit is fed to the gate electrode of the first N-channel Tr.

16 Claims, 19 Drawing Sheets

DISPLAY DEVICE AND A DRIVER CIRCUIT THEREOF

BACKGROUND OF THE INVENTION

1. Field of the Invention

The present invention relates to a driver circuit, and more particularly, to a driver circuit of a display device.

2. Description of the Related Art

Techniques of manufacturing a semiconductor device, for example, a thin film transistor (TFT), which has a semiconductor thin film formed on an inexpensive glass substrate, have been making rapid progress in recent years. This is because there is an increasing demand for active matrix liquid crystal display devices (liquid crystal display devices).

In the active matrix liquid crystal display device, several hundred thousands to several millions of TFTs are arranged in matrix in a pixel portion, and electric charges going into and out of pixel electrodes that are connected to each TFT are controlled by the switching function of the TFTs.

Conventionally, thin film transistors employing an amorphous silicon film formed on a glass substrate are arranged in the pixel portion.

Further, in recent years, a structure is known in which quartz is utilized as a substrate and thin film transistors are manufactured from a polycrystalline silicon film. In this case, both a peripheral driver circuit and a pixel portion are constructed of the thin film transistors formed on the quartz substrate.

Still further, recently, also known is a technique in which thin film transistors using a crystalline silicon film are formed on a glass substrate by laser annealing or other techniques. Employment of this technique allows a pixel portion and a peripheral driver circuit to be integrated on the glass substrate.

Active matrix liquid crystal display devices are mainly used in notebook personal computers. Different from analog data used in the current television signals (NTSC or PAL) or the like, the personal computer outputs digital data to a display device. Conventionally, digital data from a personal computer are converted into analog data and then inputted into the active matrix liquid crystal display device, or to an active matrix liquid crystal display device that utilizes an externally attached digital driver.

Therefore, a liquid crystal display device having a digital interface capable of directly inputting digital data from outside is in the spotlight.

Here, a portion of a source driver of the liquid crystal display device having a digital interface that is recently in the spotlight is shown in FIG. 17. In FIG. 17, reference numeral 8000 denotes a shift register circuit and reference numeral 8100 denotes a digital data latch circuit. The shift register 8000 generates a timing signal on the basis of a clock signal (CLK), a clock back signal (CLKB), and a start pulse (SP) which are supplied from outside, and then sends out the above timing signal to the digital data latch circuit 8100. Based on the timing signal from the shift register circuit 8000, the digital data latch circuit 8100 samples (takes in) and stores and holds digital data inputted from outside.

Note that a scanning direction switching circuit is included in the shift register circuit 8000 shown in FIG. 17. The scanning direction switching circuit is a circuit for controlling the order of the output of the timing signal from the shift register circuit 8000 from left to right or from right to left in accordance with a scanning direction switching signal inputted from outside.

In a conventional shift register circuit such as the shift register circuit 8000 shown in FIG. 17, the shift register circuit 8000 is complicated and constructed by a large number of elements. In the present situation in which an active matrix liquid crystal display device with higher resolution is demanded, the surface area of the shift register circuit becomes larger as its resolution is improved. Thus, the number of elements constructing the shift register circuit is also increased.

Because of this increase in the number of elements, the production yield in the entire liquid crystal display devices becomes worse. Further, if the possessed surface area of the circuits becomes larger, it hinders the making of small scale liquid crystal display devices.

SUMMARY OF THE INVENTION

Accordingly, the present invention has been made in view of the above problems, and an object of the present invention is therefore to attain improvement in production yield and compactness of the active matrix liquid crystal display device by providing a driver circuit that is simple as well as possessing a small surface area.

FIG. 1 is referenced. A driver circuit of the present invention is shown in FIG. 1. Reference numeral 100 denotes a shift register circuit and reference numeral 200 denotes a group of digital data latch circuits. Note that only 5 stages of the shift register circuit 100 and 1 bit of the group of digital data latch circuit 200 corresponding to the 5 stages of the shift register circuit 100 are shown in FIG. 1 for explanation conveniences. However, the driver circuit of the present invention may have n stages of shift register circuits, and may also have m bits of the group of digital data latch circuits.

The shift register circuit 100 has a plurality of register circuits 110, 120, 130, 140, and 150. An explanation is given here taking the register circuit 110 as an example. The register circuit 110 has a clocked inverter circuit 111 and an inverter circuit 112. In addition thereto, the register circuit 110 has a signal line 113 and the parasitic capacitance of the signal line 113 may be considered as elements constructing the register circuit. Further, a clock signal (CLK), a clock back signal (CLKB), and a start pulse (SP) from outside are inputted to the shift register circuit 100. These signals are fed to the register circuits 110, 120, 130, 140, and 150.

The clocked inverter circuit 111 operates in the same period with the inputted clock signal (CLK) and the clock back signal (CLKB) to thereby output the inputted start pulse (SP) to the inverter circuit 112. The inverter circuit 112 then outputs the inputted pulse signal to the signal line 113 and the register circuit 120 of the next stage. However, since a large number of elements are connected to the signal line 113, its parasitic capacitance is large resulting in having a high load. The present invention actively utilizes this high load due to the large parasitic capacitance of the signal line 113. Accordingly, timing signals are sequentially outputted at constant intervals from the register circuits 110, 120, 130, 140, and 150.

The group of digital data latch circuits 200 has digital data latch circuits 210, 220, 230, 240, and 250. An explanation is given taking the digital data latch circuit 210 as an example. The digital data latch circuit 210 has a first N-channel transistor 211, a second N-channel transistor 212, a P-channel transistor 213, and inverter circuits 214 and 215.

Digital data and a reset signal (Res) are inputted to the digital data latch circuit 210 from outside. Further, a source or drain of the P-channel transistor 213 is connected to a first power source voltage (VDD_1). The first power source voltage (VDD_1) is set higher than the operation electric potential of the N-channel transistor.

Immediately before the start pulse (SP) is fed to the shift register circuit 100, the reset signal (Res) is inputted to thereby feed the first power source voltage (VDD_1) to inverter circuits 214, 224, 234, 244, and 254. In other words, a positive logic "1 (Hi)" signal is inputted.

The timing signal from the register circuit 110 outputted through the signal line 113 is inputted to the N-channel transistor 212 of the digital data latch circuit 210, whereby the N-channel transistor 212 starts to operate. In addition, when a timing signal from the next stage register circuit 120 outputted through the signal line 123 is inputted to the N-channel transistor 211 of the digital data latch circuit 210 and the N-channel transistor 211 starts to operate, then digital data inputted from outside is taken in by the inverter circuit 214 where the digital data is held by the inverter circuits 214 and 215. At this point, if the inputted digital data from outside is "1 (Hi)", a digital data "1" is held by the inverter circuits 214 and 215. On the other hand, if the inputted digital data from outside is "0 (Lo)", "0" is inputted to the inverter circuit 214, whereby the digital data "0 (Lo)" is held by the inverter circuits 214 and 215.

FIG. 19 is referenced next. The driver circuit of the present invention is shown in FIG. 19. Reference numeral 3800 denotes a shift register circuit and reference numeral 3900 denotes a group of digital data latch circuits. Note that only 5 stages of the shift register circuit 3800 and 1 bit of the group of digital data latch circuit 3900 corresponding to the 5 stages of the shift register circuit 3800 are shown in FIG. 19 for explanation conveniences. However, the driver circuit of the present invention may have n stages of shift register circuits, and may also have m bits of the group of digital data latch circuits.

The driver circuit of the present invention that will be described here is structured differently from the driver circuit and the group of digital data latch circuits of the present invention illustrated in FIG. 1.

The group of digital data latch circuits 3900 has digital data latch circuits 3910, 3920, 3930, 3940, and 3950. An explanation is given here taking the digital data latch circuit 3910 as an example. The digital data latch circuit 3910 has a first P-channel transistor 3911, a second P-channel transistor 3912, an N-channel transistor 3913, and inverter circuits 3914 and 3915. Digital data and a reset signal (Res) are inputted to the digital data latch circuit 3910 from outside. Further, a source or drain of the N-channel transistor 3913 is connected to a second power source voltage (VSS_1). The second power source voltage (VSS_1) is set lower than the operating electric potential of the P-channel transistor.

Immediately before the start pulse (SP) is fed to the shift register circuit 3800, the reset signal (Res) is inputted to thereby feed the second power source voltage (VSS_1) to inverter circuits 3914, 3924, 3934, 3944, and 3954. In other words, a negative logic "0 (Lo)" signal is inputted.

A timing signal from a register circuit 3810 outputted through a signal line 3813 is inputted to the P-channel transistor 3912 of the digital data latch circuit 3910, whereby the P-channel transistor 3812 starts to operate. In addition, when a timing signal from a next stage register circuit 3820 outputted through a signal line 3823 is inputted to the P-channel transistor 3911 of the digital data latch circuit 3910 and the P-channel transistor 3911 starts to operate, then digital data inputted from outside is taken in by the inverter circuit 3914 where the digital data is held by the inverter circuits 3914 and 3915. At this point, if the inputted digital data from outside is "0 (Lo)", a digital data "0" is held by the inverter circuits 3914 and 3915. On the other hand, if the inputted digital data from outside is "1 (Hi)", "1" is inputted to the inverter circuit 3914, whereby the digital data "1 (Hi)" is held by the inverter circuits 3914 and 3915.

It should be noted that all the register circuits and all the digital data latch circuits perform the above explained operations.

The number of elements constructing the driver circuit of the present invention can be half or less than the number of elements of the conventional driver circuit by adopting the above structure.

Here, the structure of the present invention will be described below.

A driver circuit according to a first aspect of the present invention is comprised of:

a shift register circuit having a plurality of register circuits including a clocked inverter circuit and an inverter circuit connected in series;

a plurality of digital data latch circuits having a first N-channel transistor and a second N-channel transistor in which the sources or drains are connected in series, a P-channel transistor, and a digital data holding circuit, and is characterized in that:

the clocked inverter circuit and the inverter circuit generate a timing signal on the basis of a clock signal, a clock back signal, and a start pulse inputted from outside, and feeds the timing signal to a register circuit neighboring the register circuit and a gate electrode of the second N-channel transistor;

the P-channel transistor inputs a first electric current voltage to the digital data holding circuit in accordance with a reset signal that is inputted from outside to a gate electrode of the P-channel transistor;

the first N-channel transistor takes in digital data inputted on the basis of the timing signal and feeds the digital data to the source or the drain of the second N-channel transistor; and the timing signal outputted from a register circuit neighboring the register circuit is fed to a gate electrode of the first N-channel transistor.

A driver circuit according to a second aspect of the present invention is comprised of:

a shift register circuit having a register circuit including a clocked inverter circuit and an inverter circuit connected in series;

a digital data latch circuit having a first N-channel transistor and a second N-channel transistor in which the sources or drains are connected in series, a P-channel transistor, and a digital data holding circuit, and is characterized in that:

a gate electrode of the second N-channel transistor is connected to the output line of the register circuit, a source or a drain of the second N-channel transistor is connected to a source or a drain of the first N-channel transistor, and the other end of the source or the drain of the second N-channel transistor is connected to the digital data holding circuit;

a gate electrode of the first N-channel transistor is connected to the output line of a register circuit neighboring the register circuit and the other end of the source or the drain of the first N-channel transistor is connected to a signal line to which digital data are inputted; and a gate electrode of the P-channel transistor is connected to a signal line to which a reset signal is inputted and one end of a source or a drain of the P-channel transistor is connected to a first power source whereas the other end of the source or the drain of the P-channel transistor is connected to the digital data holding circuit.

A driver circuit according to a third aspect of the present invention is comprised of:

a shift register circuit having a plurality of register circuits including a clocked inverter circuit and an inverter circuit connected in series;

a plurality of digital data latch circuits having a first P-channel transistor and a second P-channel transistor in which the sources or drains are connected in series, an N-channel transistor, and a digital data holding circuit, and is characterized in that:

the clocked inverter circuit and the inverter circuit generate a timing signal on the basis of a clock signal, a clock back signal, and a start pulse inputted from outside and feeds the timing signal to a register circuit neighboring the register circuit and to a gate electrode of the second P-channel transistor;

the N-channel transistor feeds a second electric current voltage to the digital data holding circuit in accordance with a reset signal that is inputted from outside to a gate electrode of the N-channel transistor;

the first P-channel transistor takes in digital data inputted on the basis of the timing signal and feeds the digital data to the source or the drain of the second P-channel transistor; and the timing signal outputted from a register circuit neighboring the register circuit is fed to a gate electrode of the first P-channel transistor.

A driver circuit according to a fourth aspect of the present invention is comprised of:

a shift register circuit having a register circuit including a clocked inverter circuit and an inverter circuit connected in series;

a digital data latch circuit having a first P-channel transistor and a second P-channel transistor in which the sources or drains are connected in series, an N-channel transistor, and a digital data holding circuit, and is characterized in that:

a gate electrode of the second P-channel transistor is connected to the output line of the register circuit, a source or a drain of the second P-channel transistor is connected to a source or a drain of the first P-channel transistor, and the other end of the source or the drain of the second P-channel transistor is connected to the digital data holding circuit;

a gate electrode of the first P-channel transistor is connected to the output line of a register circuit neighboring the register circuit and the other end of the source or the drain of the first P-channel transistor is connected to a signal line to which digital data are inputted; and a gate electrode of the N-channel transistor is connected to a signal line to which a reset signal is inputted and one end of a source or a drain of the N-channel transistor is connected to a second power source whereas the other end of the source or the drain of the N-channel transistor is connected to the digital data holding circuit.

DETAILED DESCRIPTION OF THE PREFERRED EMBODIMENTS

Hereinafter, an embodiment mode of the present invention will be explained.

Figure 1:
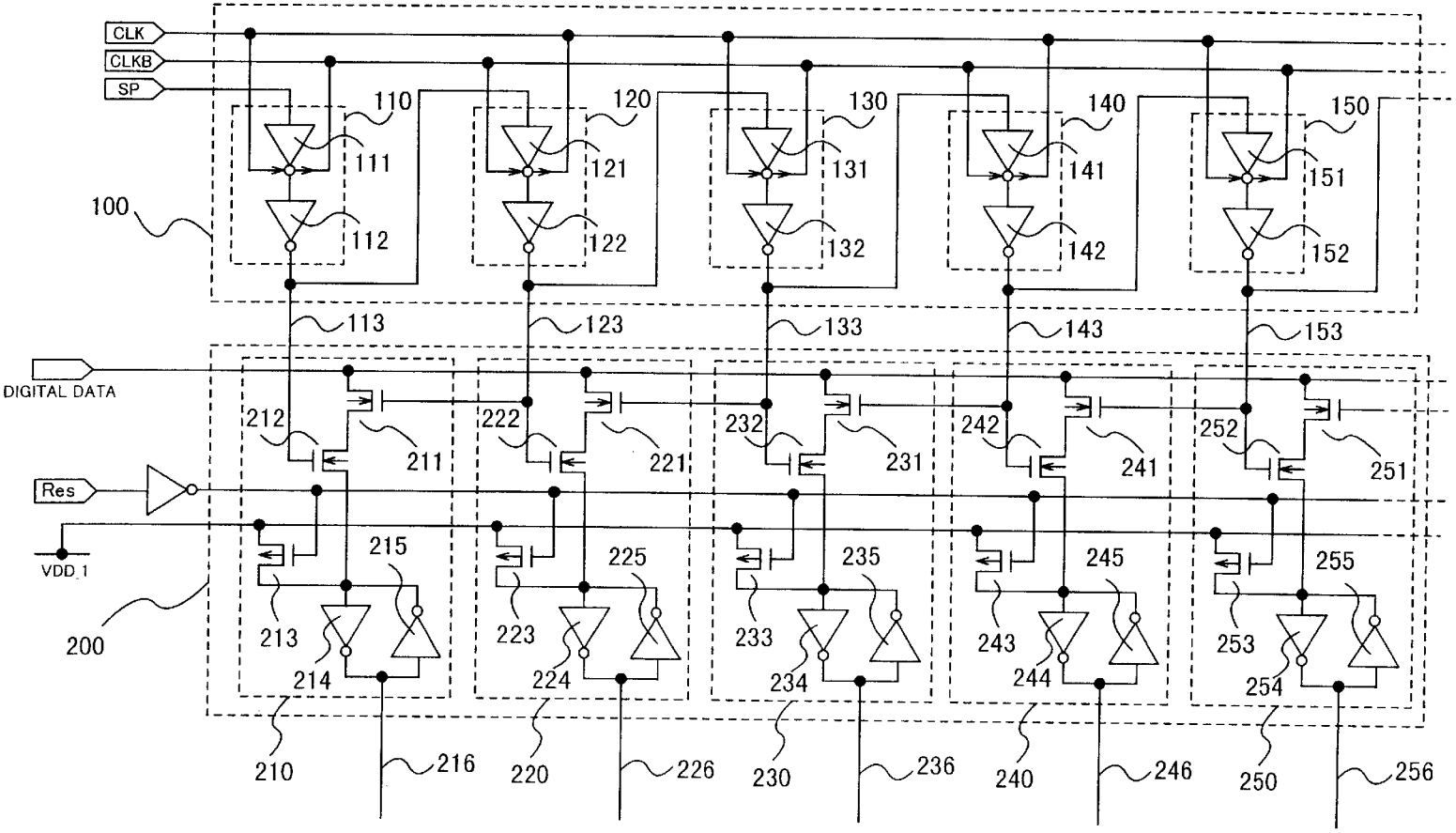
FIG. 1 is a circuit diagram showing a configuration of a driver circuit according to the present invention.
Figure 2:
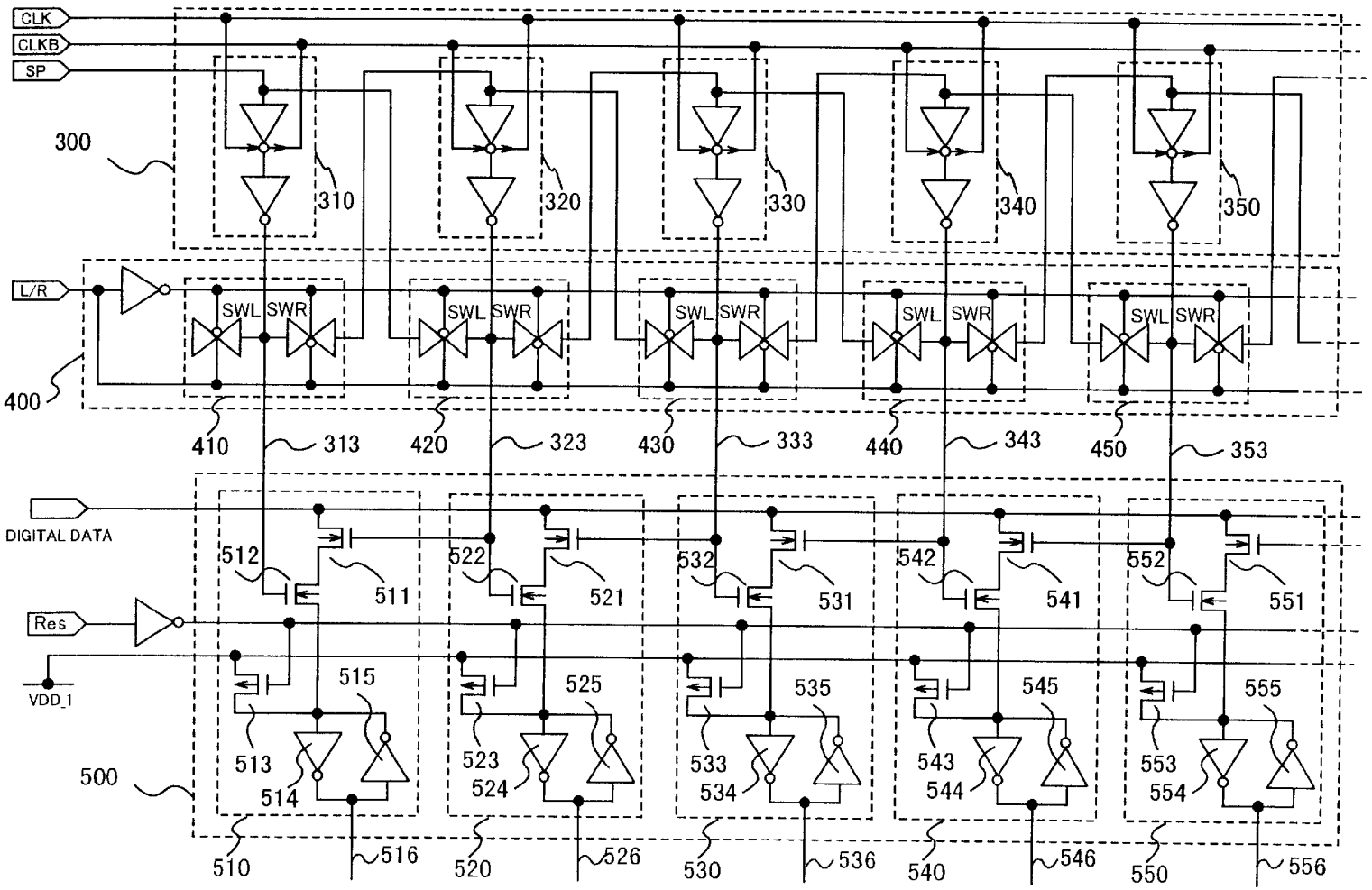
FIG. 2 is a circuit diagram showing a configuration of a driver circuit according to the present invention.

FIG. 2 is referenced. Shown in FIG. 2 is an embodiment mode of a driver circuit of the present invention. In FIG. 2, reference numeral 300 denotes a shift register circuit, reference numeral 400 denotes a left/right scanning direction switching circuit, and reference numeral 500 denotes a group of digital data latch circuits. Note that even in FIG. 2, only 5 stages of the shift register circuit 300, and the left/right scanning direction switching circuit 400 and 1 bit of the group of the digital data latch circuits 500 all corresponding to the 5 stages of the shift register circuit 300 are shown for explanation conveniences. However, the driver circuit of the present invention may have n stages of shift register circuits, and may also have m bits of the group of digital data latch circuits.

The shift register circuit 300 has a plurality of register circuits 310, 320, 330, 340. and 350. It should be noted that as explained above, the shift register circuit may have n stages of register circuits.

An explanation is given here taking the register 310 as an example. The register circuit 310 has a clocked inverter circuit and an inverter circuit. In addition thereto, the register circuit 310 has a signal line 313 and the parasitic capacitance of the signal line 313 may also be considered as elements constructing the register circuit. Further, a clock signal (CLK), a clock back signal (CLKB), and a start pulse (SP) from outside are inputted to the shift register circuit 300. These signals are fed to the register circuits 310, 320, 330, 340, and 350.

The scanning direction switching circuit 400 will be explained. The scanning direction switching circuit 400 has a plurality of switching circuits 410, 420, 430, 440, and 450. The switching circuits 410, 420, 430, 440, and 450 respectively have 2 analog switches, SWL and SWR. These switching circuits 410, 420, 430, 440, and 450 are circuits that control whether to output the outputted signals from the register circuits to either the left or the right register circuit depending upon a scanning direction switching signal (LIR) inputted from outside.

In the embodiment mode of the present invention, the analog switch SWR operates upon input of a left/right direction switching signal (L/R) that is "0 (Lo)", whereby the timing signal outputted from the register circuit 310 is inputted to the right-neighboring register circuit 320. Further, the timing signal outputted from the register circuit 320 is then inputted to the right-neighboring register circuit 330. In this way, when the "0 (Lo)" scanning direction switching signal (LIR) is inputted, the timing signal generated at constant intervals is sequentially outputted to the next right-neighboring register circuit.

In this case, the register circuit 310 outputs the timing signal through the signal line 313 to the digital data latch circuit 510 of the group of digital data latch circuits and to the next register circuit 323. However, since a large number of elements are connected to the signal line 313, its parasitic capacitance is large resulting in having a high load.

The digital data latch circuit 510 has 2 N-channel transistors, a P-channel transistor and 2 inverter circuits. Digital data and a reset signal (Res) are inputted to the digital data latch circuit 510 from outside. Further, a source or drain of the P-channel transistor is connected to a first power source voltage (VDD_1).

Immediately before a start pulse (SP) is inputted into the shift register circuit 300, the reset signal (Res) is inputted to thereby input the first electric potential (VDD_1) to inverter circuits 514, 524, 534, 544, and 554. In other words, a positive logic "1 (Hi)" signal is inputted.

The timing signal from the register circuit 310 outputted through the signal line 313 is fed to an N-channel transistor 512 of the digital data latch circuit 510, whereby the N-channel transistor 512 starts to operate. In addition, when a timing signal from the next stage register circuit 320 outputted through the signal line 323 is inputted to an N-channel transistor 511 of the digital data latch circuit 510 and the N-channel transistor 511 starts to operate, then digital data inputted from outside is taken in by an inverter circuit 514 where the digital data is held by inverter circuits 514 and 515. At this point, if the inputted digital data from outside is "1 (Hi)", a digital data "1" is held by the inverter circuits 514 and 515. On the other hand, if the inputted digital data from outside is "0 (Lo)", "0" is inputted to the inverter circuit 514, whereby the digital data "0 (Lo)" is held by the inverter circuits 514 and 515.

In addition, the analog switch SWL operates upon input of a left/right direction switching signal (L/R) that is "1 (Hi)", whereby the timing signal outputted from the register circuit 350 is inputted to the left-neighboring register circuit 340. Further, the pulse outputted from the register circuit 340 is then inputted to the left-neighboring register circuit 330. In this way, when the "1 (Hi)" scanning direction switching signal (LIR) is inputted, the timing signal generated at constant intervals is sequentially outputted to the next left-neighboring register circuit.

The digital latch circuits 510 to 550 of the group of digital data latch circuits 500 operates similarly when the above explained scanning direction switching signal (L/R) is "0 (Lo)".

Figure 3:
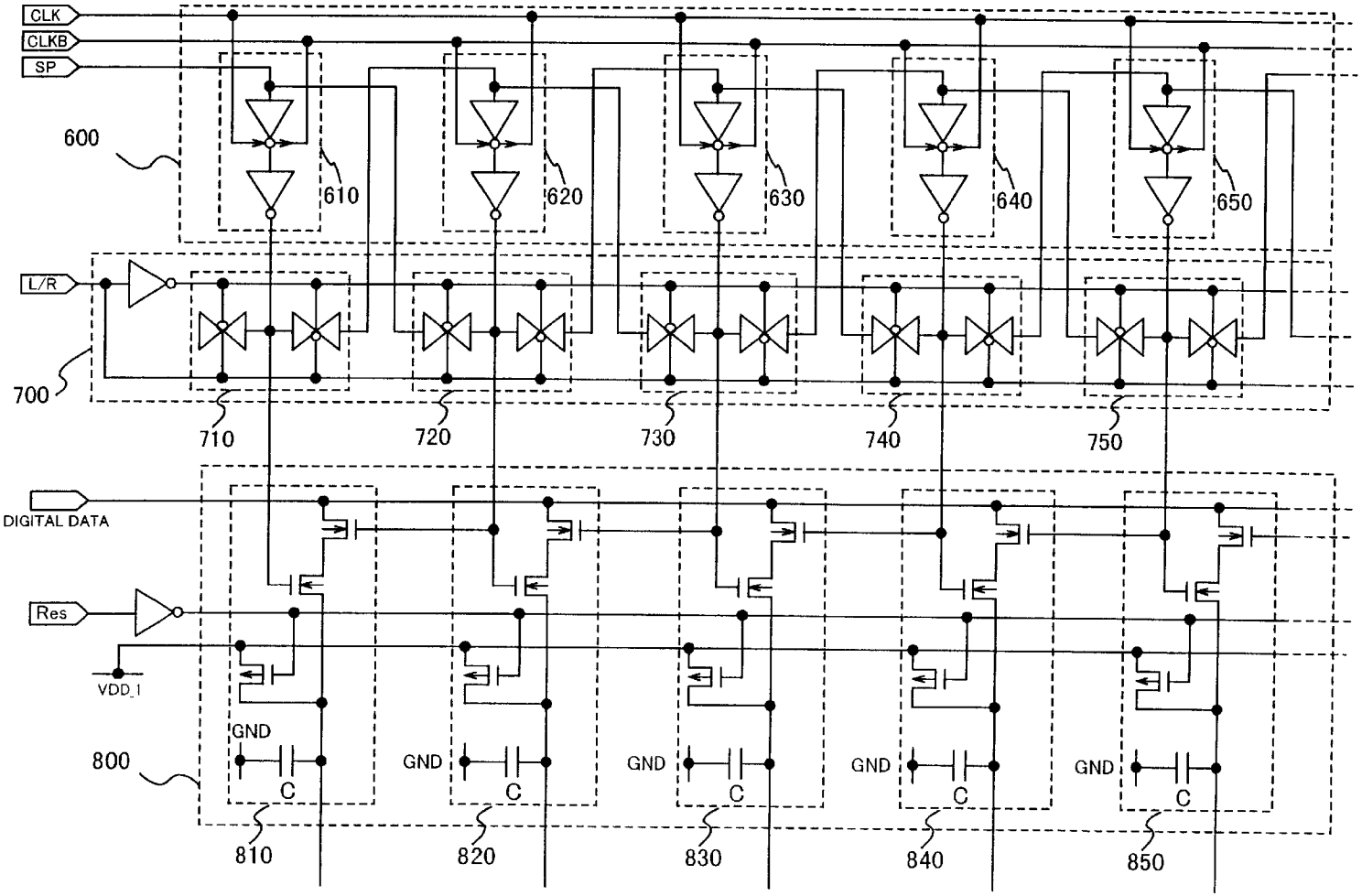
FIG. 3 is a circuit diagram showing a configuration of a driver circuit according to the present invention.

FIG. 3 is referenced next. Shown in FIG. 3 is the driver circuit of the present invention in which the corridor structure of the group of digital data latch circuits of the above driver circuit has been changed.

In FIG. 3, reference numeral 600 denotes a shift register circuit, reference numeral 700 denotes a scanning direction switching circuit, and reference numeral 800 denotes a group of digital data latch circuits. The driver circuit of the present invention explained here includes a capacitance C for holding inputted digital data and the first electric source voltage (VDD_1) inputted in accordance with the reset signals (Res) in the respective digital data latch circuits 810, 820, 830, 840, and 850 composing the group of digital data latch circuit 800.

A more simple driver circuit can be realized by adopting such structure.

Figure 18:
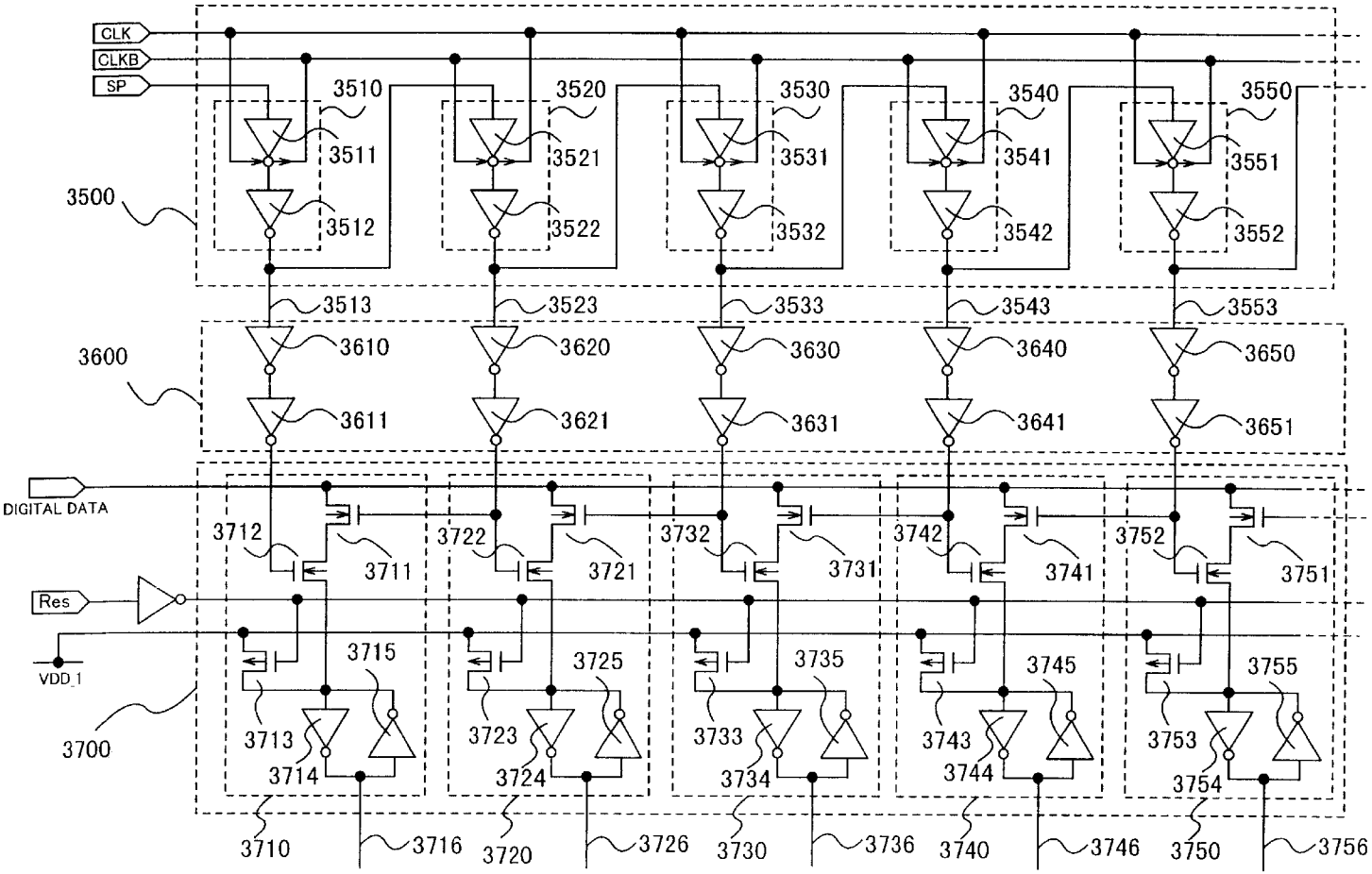
FIG. 18 is a circuit diagram showing a configuration of a driver circuit according to the present invention.
Figure 19:
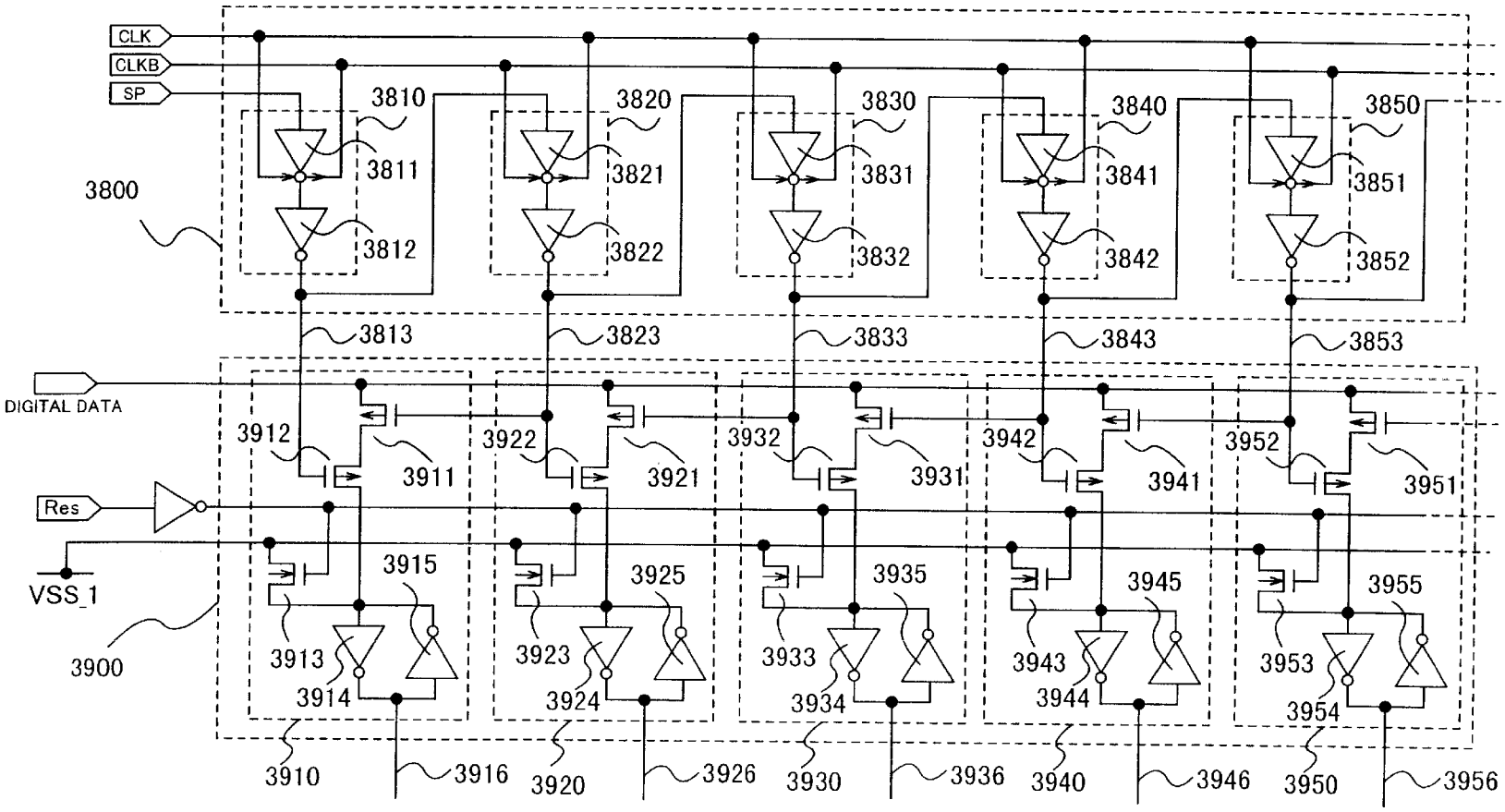
FIG. 19 is a circuit diagram showing a configuration of a driver circuit according to the present invention.

FIG. 18 is referenced next. FIG. 18 is a view showing a circuit structure of the driver circuit of the present invention for the case of providing a buffer circuit between the shift register circuit and the group of digital data latch circuits.

In FIG. 18, reference numerals 3500, 3600, and 3700 denote a shift register circuit, a buffer circuit, and a group of digital data latch circuits, respectively.

The buffer circuit 3600 has inverter circuits 3610, 3620, 3621, 3630, 3631, 3640, 3641, 3650, and 3651.

The above explanations of the driver circuit of the present invention can be referenced for other aspects of the present invention.

Hereinafter, preferred embodiments of the present invention will be described.

Embodiment 1

Figure 4:
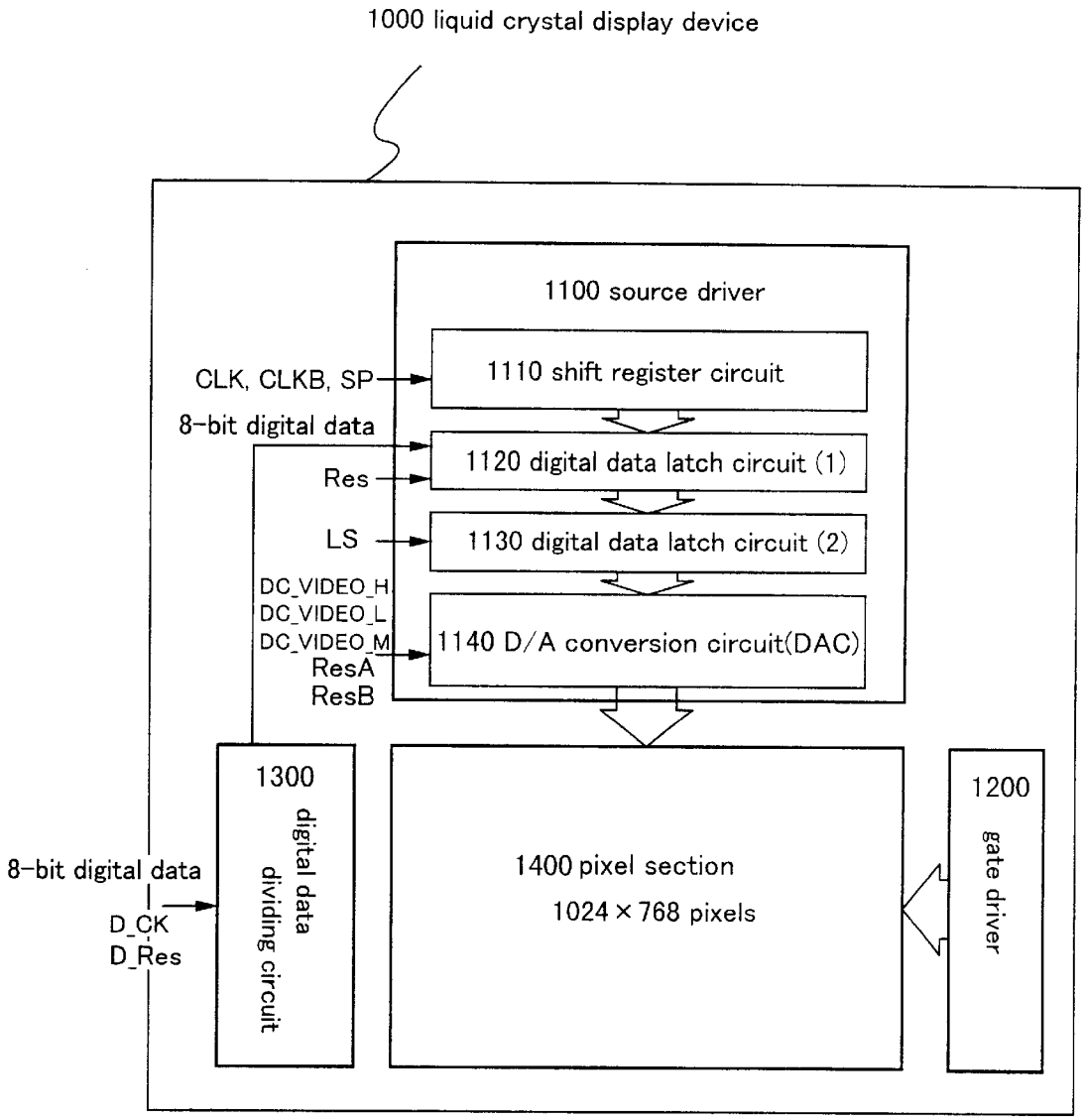
FIG. 4 is a circuit block diagram of a liquid crystal display device employing a driver circuit according to the present invention.

FIG. 4 is referred to. A liquid crystal display device of Embodiment 1 employing the driver circuit of the present invention is shown in FIG. 4. A liquid crystal display device 1000 of Embodiment 1 has a source driver 1100, a gate driver 1200, a digital video data dividing circuit 1300 and a pixel section 1400. 8-bit digital data from outside are inputted to the liquid crystal display device 1000 of Embodiment 1. In addition, the pixel section of the liquid crystal display device 1000 of Embodiment 1 has 1024×768 pixels (width x length).

The source driver 1100 of Embodiment 1 has a shift register circuit 1110, a digital data latch circuit (1) 1120, a digital data latch circuit (2) 1130, and a D/A conversion circuit (DAC) 1140. Note that the shift register circuit 1110 has a scanning direction switching circuit (not shown in the figure), and furthermore, the D/A conversion circuit 1140 has a level shifter circuit (not shown in the figure).

The gate driver 1200 of Embodiment 1 has a shift register circuit and a buffer circuit (both not shown in the figure). Note that the gate driver of Embodiment 1 is obtained by utilizing the shift register circuit of the present invention.

Reference numeral 1300 denotes the digital data dividing circuit (SPC: Serial-to-Parallel Conversion Circuit). The digital data dividing circuit 1300 is a circuit to drop the frequency of digital data inputted to the liquid crystal display device 1000 from an external device to 1/m. The frequency of a signal necessary for operating the driver circuits can also be dropped to 1/m by dividing the digital video data inputted from outside.

In this embodiment, 8-bit digital data of 80 MHZ inputted from outside are fed to the digital data dividing circuit 1300. The digital data dividing circuit 1300 performs serial-parallel conversion on the 8-bit digital data of 80 MHZ inputted from outside, to thereby feed the source driver 1100 with digital data of 40 MHZ.

A detailed description is given here on the operation of the shift register circuit 1110 and the digital data latch circuit (1) of the liquid crystal display device 1000 of Embodiment 1.

Figure 5:
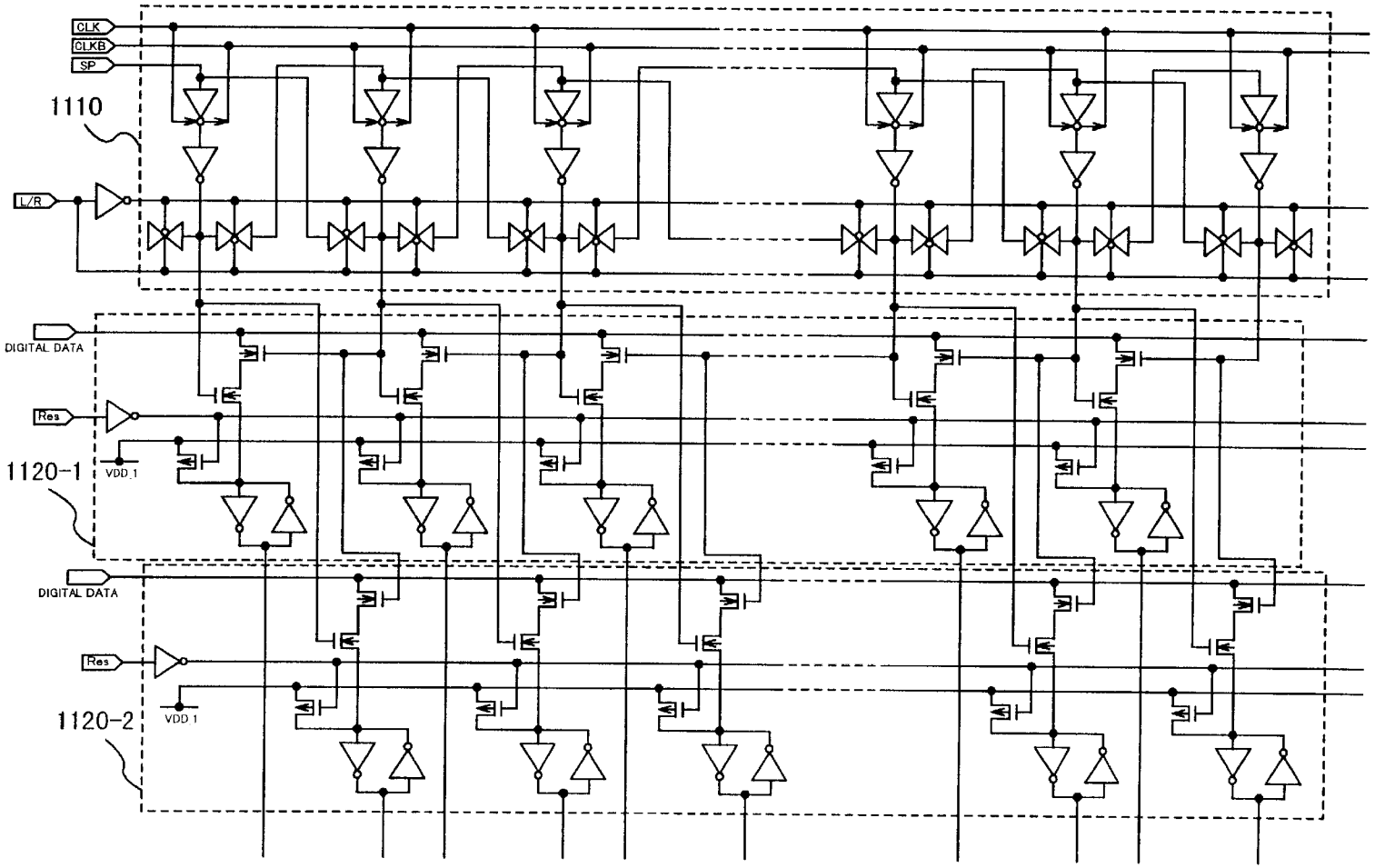
FIG. 5 is a circuit diagram showing a configuration of a driver circuit according to the present invention.

FIG. 5 is referred to. The shift register circuit 1100 and the group of digital data latch circuits (1) 1120-1 and 1120-2 of Embodiment 1 are shown in FIG. 5. It should be noted that for explanation conveniences, the digital data latch circuits 1120-1 and 1120-2 are shown in FIG. 5 as the group of digital data latch circuits (1). However, the source driver 1100 of Embodiment 1 has 16 digital data latch circuits, 1120-1 to 1120-16.

Note that in Embodiment 1, the scanning direction switching circuit is considered as a part of the shift register circuit 1110. However, the scanning direction switching circuit can be omitted from the shift register if a liquid crystal display device that does not need its scanning direction to be switched employs the shift register circuit of Embodiment 1.

A description is given here on the operation of the driver circuit of the liquid crystal display device of Embodiment 1.

First, a clock signal (CLK), a clock back signal (CLKB), and a start pulse (SP) are inputted to the shift register circuit 1110. In the driver circuit of the present invention as explained above, the shift register circuit 1110 sequentially generates timing signals on the basis of the clock signal (CLK), the clock back signal (CLKB), and the start pulse (SP) to sequentially output the timing signals to the digital data latch circuits constituting the group of digital data latch circuits (1).

The timing signals outputted from the shift register circuit 1110 are fed to the digital data latch circuits (1)1120-1 to 1120-16. The group of digital data latch circuits (1) 1120-1 to 1120-16 sequentially takes in and holds 8-bit digital data fed from the digital data dividing circuit upon input of the timing signals.

The time necessary to complete writing of the digital data into all the stages of the group of digital data latch circuits (1) 1120-1 to 1120-16 is called a line term. In other words, when the shift register circuit 1110 sequentially generates timing signals from the left to the right, the line term is defined as a time interval from the start of writing the digital data into the digital data latch circuit of the most left stage to the end of writing the digital data into the digital data latch circuit of the right most stage in the group of digital data latch circuits (1) 1120-1 to 1120-16. In effect. horizontal retrace term added to the above-defined line term may also be referred to as the line term.

After the completion of one line term, a latch signal (LS) is fed to the group of digital data latch circuits (2) 1130 with the operating timing of the shift register circuits 1110. In this moment, the digital data written in and held by the group of digital data latch circuits (1) 1120 are sent all at once to the group of digital data latch circuits (2) 1130 to be written in and held by all stages of the group of digital data latch circuits (2) 1130.

The group of digital data latch circuits (1) 1120, after sending the digital data to the group of digital data latch circuits (2) 1130, again accepts sequential writing in of digital data newly fed from the digital data signal dividing circuit, on the basis of timing signals from the shift register circuit 1110.

During this second time one line term, the digital data written in and held by the group of digital data latch circuits (2) 1130 are outputted to the D/A conversion circuit 1140. The D/A conversion circuit 1140 then outputs analog data to corresponding source signal lines on the basis of the inputted digital data.

The analog data fed to the source signal lines are then fed to source regions of pixel TFTs in the pixel portion 1400 connected to the source signal lines.

In the gate driver 1200, the timing signals from the shift register (not shown in the figure) are fed to the buffer circuit (not shown in the figure) to be fed to corresponding gate signal lines (scanning lines). The gate signal lines are connected to the gate electrodes of the pixel TFTs of one line and since all the pixel TFTs of one line have to be turned ON simultaneously, it requires the use of a buffer circuit with a large electric current capacity.

In this way, a corresponding pixel TFT is switched by a scanning signal sent from the gate driver, and the analog data (gradation voltage) sent from the source driver are fed to the pixel TFTs to drive liquid crystal molecules.

Embodiment 2

The structure of a group of digital data latch circuits (1) of a source driver in a liquid crystal display device of Embodiment 2 is different from the one in the liquid crystal display device of Embodiment 1. The structure of the other circuits are the same as the ones in the liquid crystal display device of Embodiment 1.

Figure 6:
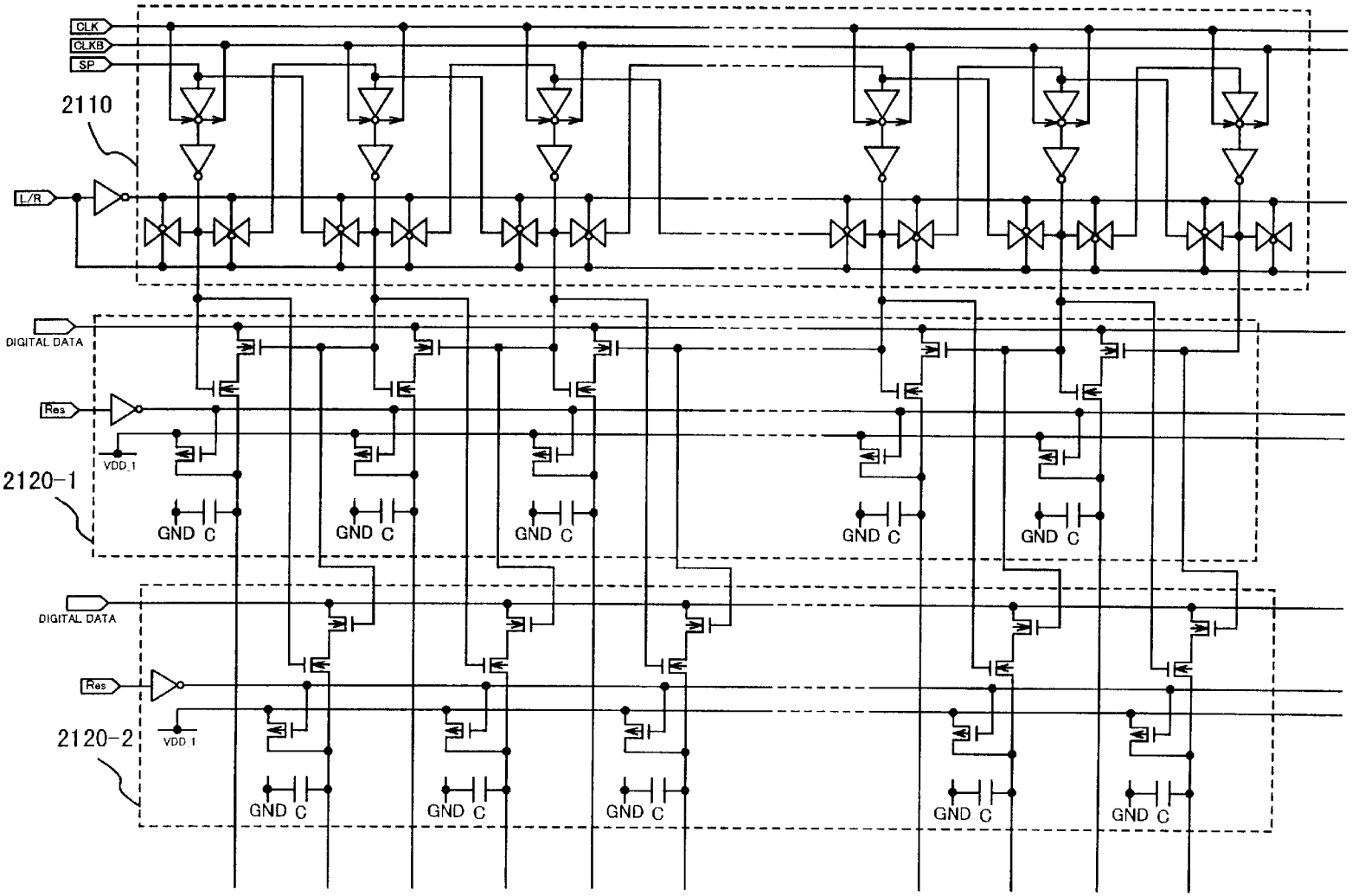
FIG. 6 is a circuit diagram showing a configuration of a driver circuit according to the present invention.

FIG. 6 is referenced. A shift register circuit 2110 of the source driver and a group of digital data latch circuits (1) 2120-1 and 2120-2 of the liquid crystal display device of Embodiment 2 are shown in FIG. 6. It should be noted that for explanation conveniences, the digital data latch circuits 2120-1 and 2120-2 are shown in FIG. 6 as the group of digital data latch circuits (1). However, the source driver 2100 of Embodiment 2 has 16 digital data latch circuits, 2120-1 to 2120-16.

The group of digital data latch circuits (1) 2120-1 to 2120-16 in Embodiment 2 has capacitors as elements for holding the digital data.

A source driver with a lesser number of elements can be realized by adopting the structure of Embodiment 2.

Embodiment 3

The structure of a group of digital data latch circuits (1) of a source driver in a liquid crystal display device of Embodiment 3 is different from the one in the liquid crystal display device of Embodiment 1. The structure of the other circuits are the same as the ones in the liquid crystal display device of Embodiment 1.

Figure 7:
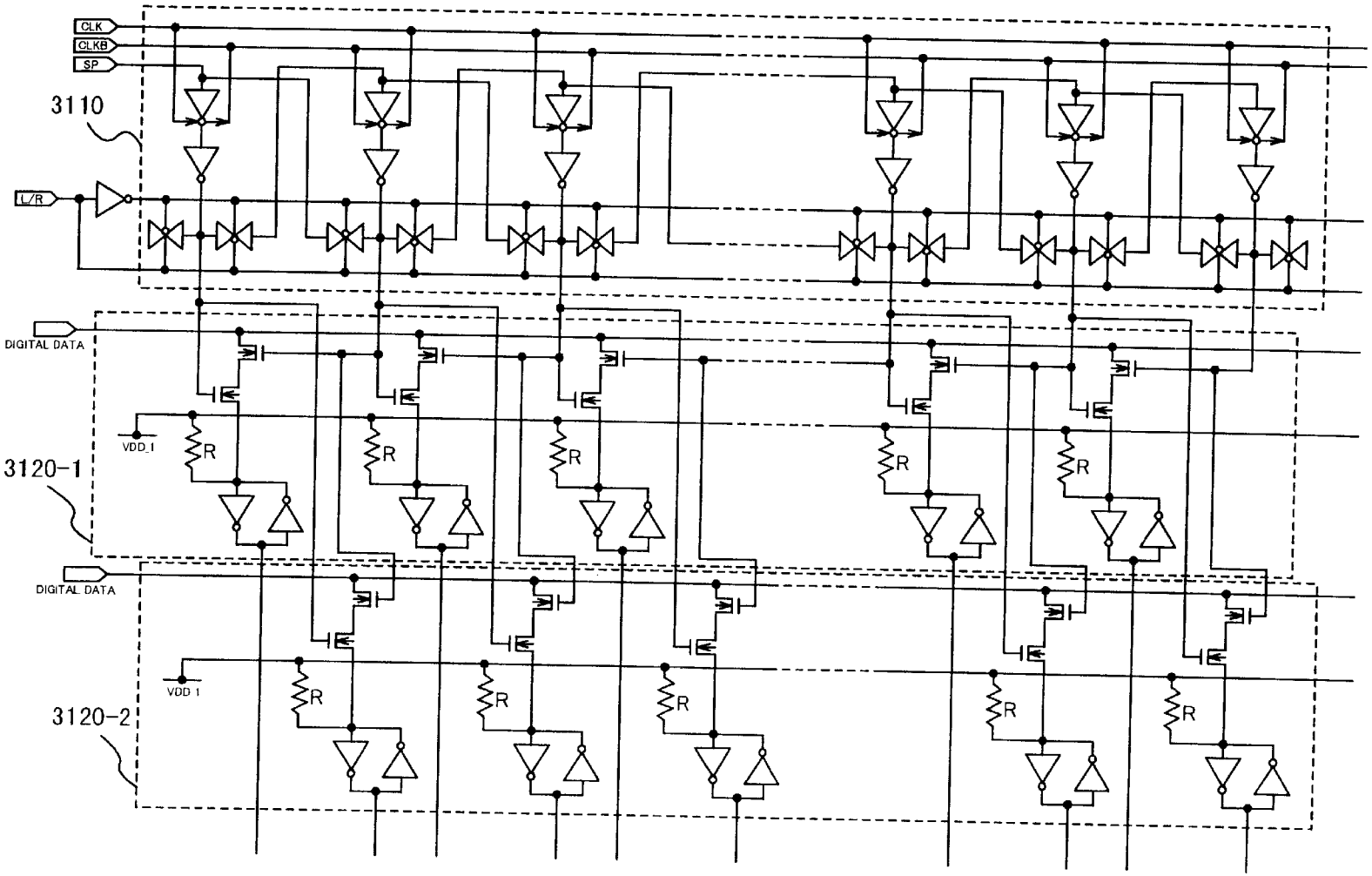
FIG. 7 is a circuit diagram showing a configuration of a driver circuit according to the present invention.

FIG. 7 is referenced. A shift register circuit 3110 of the source driver and a group of digital data latch circuits (1) 3120-1 and 3120-2 of the liquid crystal display device of Embodiment 3 are shown in FIG. 7. It should be noted that for explanation conveniences, the digital data latch circuits 3120-1 and 3120-2 are shown in FIG. 7 as the group of digital data latch circuits (1). However, the source driver 3100 of Embodiment 3 has 16 digital data latch circuits, 3120-1 to 3120-16.

The group of digital data latch circuits (1) 3120-1 to 3120-16 are connected to resistors R, substituting for the P-channel TFTs used in Embodiment 1 to which reset signals (Res) are inputted.

Embodiment 4

A method for manufacturing a liquid crystal display device having a driver circuit of the invention is described in this Embodiment by referring to FIGS. 8A to 12. A pixel section, a source driver, a gate driver, etc., are formed in a liquid crystal display device of this Embodiment integrally over a substrate. Note that a pixel TFT, an n-channel TFT which comprises a part of the driver circuit of the invention, and a p-channel TFT and an n-channel TFT which comprise an inverter circuit are shown to be formed on the same substrate for the simplification of explanation.

Figures 8A, 8B, 8C, 8D:
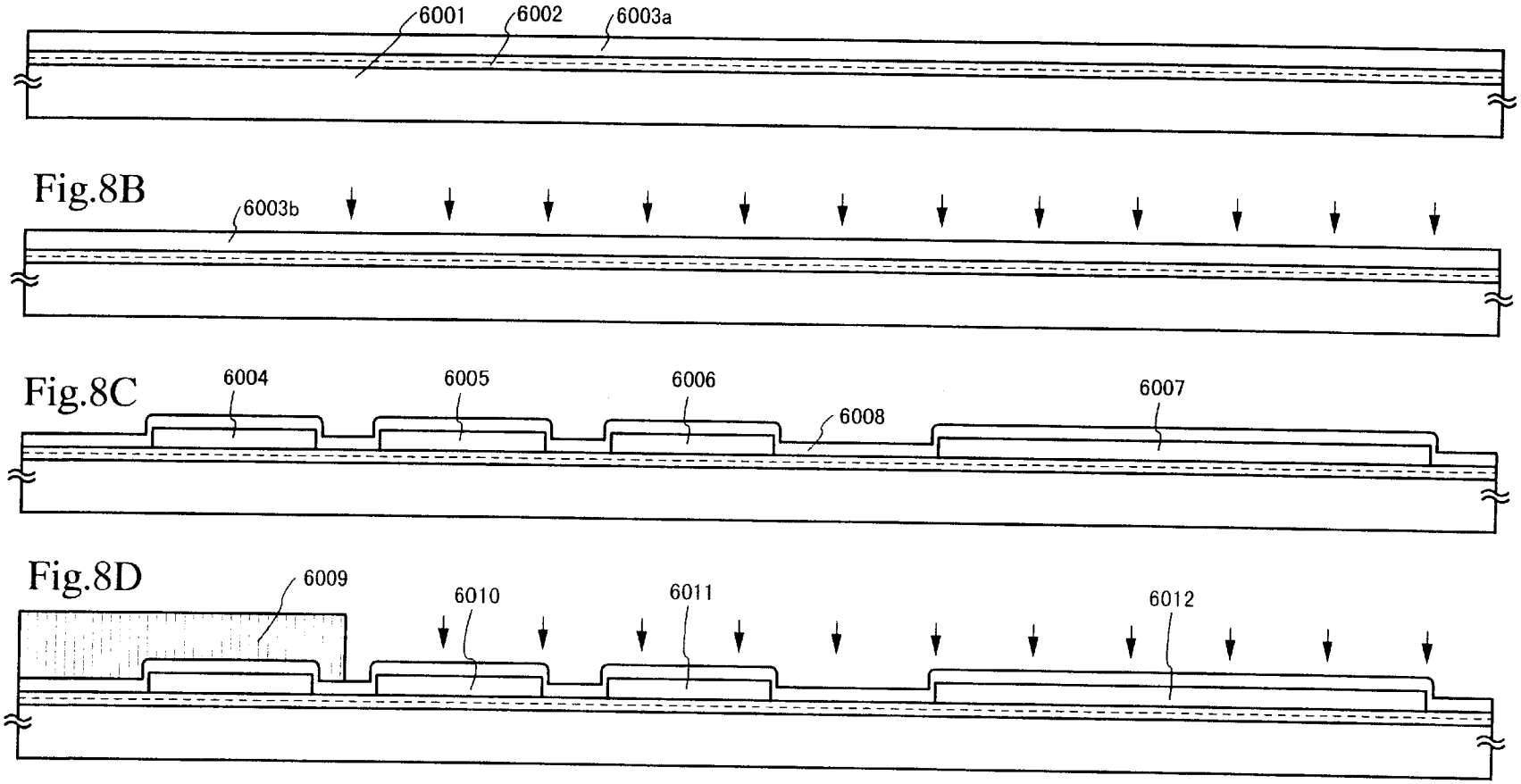
FIGS. 8A to 8D are diagrams showing an example of a process of manufacturing a liquid crystal display device employing a driver circuit according to the present invention.

Referring to FIG. 8A, a low-alkaline glass substrate or a quartz substrate can be used as a substrate 6001. In this embodiment, a low-alkaline glass substrate was used. In this case, a heat treatment at a temperature lower by about 10 to 20° C. than the strain point of glass may be performed in advance. On the surface of this substrate 6001 on which TFTs are to be formed, a base film 6002 such as a silicon oxide film, a silicon nitride film or a silicon oxynitride film is formed in order to prevent the diffusion of impurities from the substrate 6001. For example, a silicon oxynitride film which is fabricated from $SiH_4$, $NH_3$, $N_2O$ by plasma CVD into 100 nm thickness and a silicon oxynitride film which is similarly fabricated from $SiH_4$ and $N_2O$ into 200 nm thickness are formed into a laminate.

Next, a semiconductor film 6003*a* that has an amorphous structure and a thickness of 20 to 150 nm (preferably, 30 to 80 nm) is formed by a known method such as plasma CVD or sputtering. In this embodiment, an amorphous silicon film is formed to a thickness of 54 nm by plasma CVD. As semiconductor films which have an amorphous structure, there are an amorphous semiconductor film and a microcrystalline semiconductor film; and a compound semiconductor film with an amorphous structure such as an amorphous silicon germanium film may also be applied. Further, the ground film 6002 and the amorphous silicon film 6003*a* can be formed by the same deposition method, so that the two films can be formed in succession. By not exposing the base film to the atmospheric air after the formation of the base film, the surface of the base film can be prevented from being contaminated, as a result of which the dispersion in characteristics of the fabricated TFTs and the variation in the threshold voltage thereof can be reduced. (FIG. 8A)

Then, by a known crystallization technique, a crystalline silicon film 6003*b* is formed from the amorphous silicon film 6003*a*. For example, a laser crystallization method or a thermal crystallization method (solid phase growth method) may be applied, however, here, in accordance with the technique disclosed in Japanese Patent Application Laid-Open No. Hei 7-130652, the crystalline silicon film 6003*b* was formed by the crystallization method using a catalytic element. It is preferred that, prior to the crystallization step, heat treatment is carried out at 400 to 500° C. for about one hour though it depends on the amount of hydrogen contained, so that, after the amount of hydrogen contained is reduced to 5 atomic % or less, the crystallization is carried out. The atoms are subjected to re-configuration to become dense when an amorphous silicon film is crystallized; and therefore, the thickness of the crystalline silicon film fabricated is reduced by about 1 to 15% than the initial thickness of the amorphous silicon film (54 nm in this embodiment). (FIG. 8B)

Then, the crystalline silicon film 6003*b* is divided into island-shaped portions, whereby island semiconductor layers 6004 to 6007 are formed. Thereafter, a mask layer 6008 of a silicon oxide film is formed to a thickness of 50 to 150 nm by plasma CVD or sputtering. (FIG. 8C) In this Embodiment the thickness of the mask layer 6008 is set at 130 nm.

Then, a resist mask 6009 is provided, and, into the who le surfaces of the island semiconductor layers 6004 to 6007 forming the n-channel type TFTs, boron (B) was added as an impurity element imparting p-type conductivity, at a concentration of about $1\times10^{16}$ to $5\times10^{17}$ atoms/cm$^3$. The addition of boron (B) is performed for the purpose of controlling the threshold voltage. The addition of boron (B) may be effected either by ion doping or it may be added simultaneously when the amorphous silicon film is formed. The addition of boron (B) here was not always necessary. (FIG. 8D)

In order to form the LDD regions of the n-channel TFTs in the driving circuit, an impurity element imparting n-type conductivity is selectively added to the island semiconductor layers 6010 to 6012. For this purpose, resist masks 6013 to 6016 are formed in advance. As the impurity element imparting the n-type conductivity, phosphorus (P) or arsenic (As) may be used; here, in order to add phosphorus (P), ion doping using phosphine ($PH_3$) was applied. The concentration of phosphorus (P) in the impurity regions 6017 and 6018 thus formed may be set within the range of from $2\times10^{16}$ to $5\times10^{19}$ atoms/cm$^3$. In this specification, the concentration of the impurity element contained in the thus formed impurity regions 6017 to 6019 imparting n-type conductivity is represented by ($n^-$). Further, the impurity region 6019 is a semiconductor layer for forming the storage capacitor of the pixel section; into this region, phosphorus (P) was also added at the same concentration. (FIG. 9A) Thereafter, resist masks 6013 to 6016 are removed.

Figures 9A, 9B, 9C, 9D:
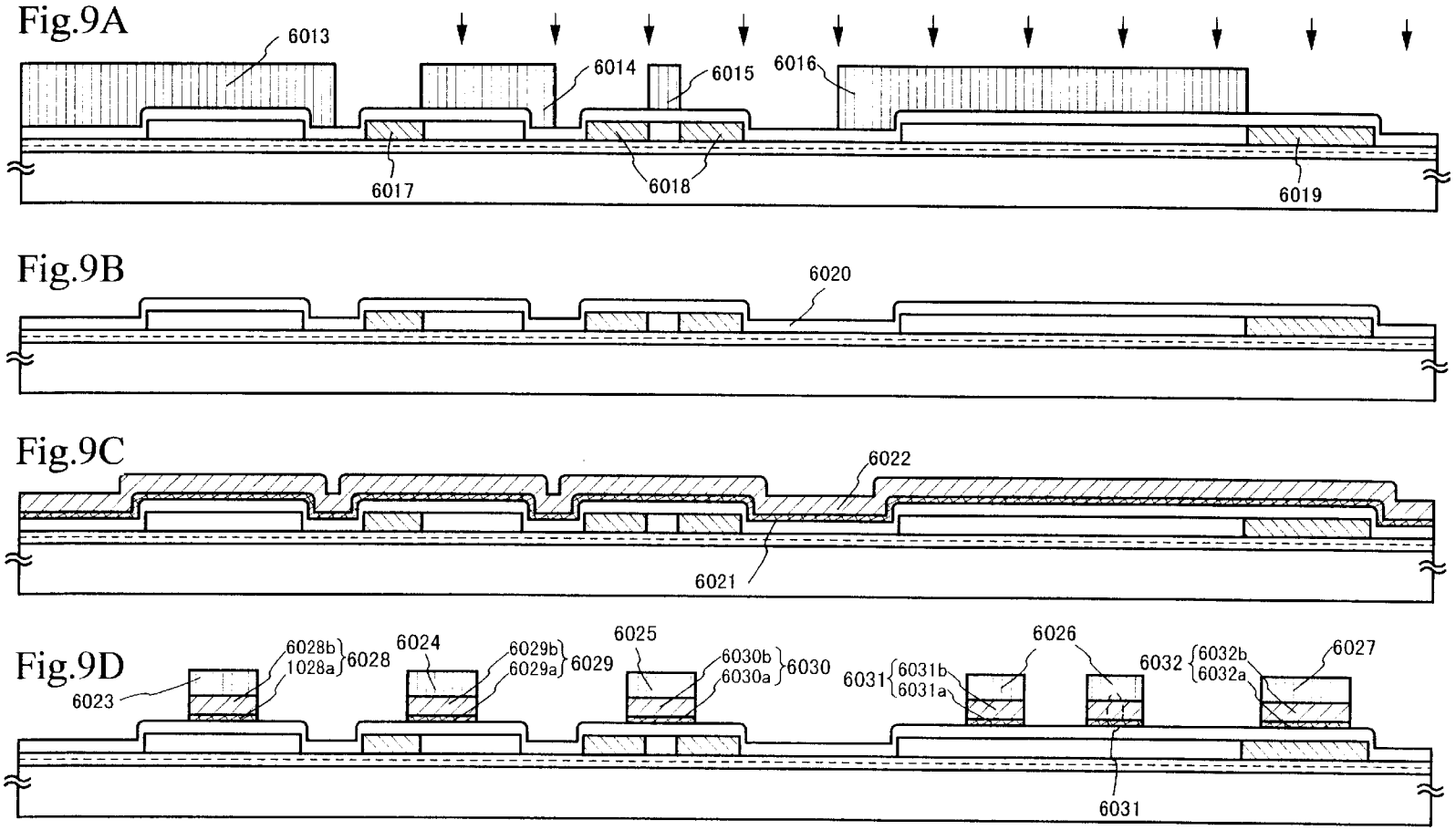
FIGS. 9A to 9D are diagrams showing an example of a process of manufacturing the liquid crystal display device employing a driver circuit according to the present invention.

Next, the mask layer 6008 is removed by hydrofluoric acid or the like, and the step of activating the impurity elements added at the steps shown in FIG. 8D and FIG. 9A is carried out. The activation can be carried out by performing heat treatment in a nitrogen atmosphere at 500 to 600° C. for 1 to 4 hours or by using the laser activation method. Further, both methods may be jointly performed. In this embodiment, the laser activation method is employed. KrF excimer laser beam (with a wavelength of 248 nm) is for the laser light. The laser beam is used in this Embodiment by forming its shape into a linear beam and scan was carried out under the condition that the oscillation frequency was 5 to 50 Hz, the energy density was 100 to 500 mJ/cm$^2$, and the overlap ratio of the linear beam was 80 to 98%, whereby the whole substrate surface on which the island semiconductor layers were formed is processed. Any item of the laser irradiation condition is subjected to no limitation, so that the operator may suitably select the condition.

Then, a gate insulator film 6020 is formed of an insulator film comprising silicon to a thickness of 10 to 150 nm, by plasma CVD or sputtering. For example, a silicon oxynitride film is formed to a thickness of 120 nm. As the gate insulator film, another insulator film comprising silicon may be used as a single layer or a laminate structure. (FIG. 9B)

Next, in order to form a gate electrode, a first conductive layer is deposited. This first conductive layer may be comprised of a single layer but may also be comprised of a laminate consisting of two or three layers if necessary. In this embodiment, a conductive layer (A) 6021 comprising a conductive metal nitride film and a conductive layer (B) 6022 comprising a metal film are laminated. The conductive layer (B) 6022 may be formed of an element selected from among tantalum (Ta), titanium (Ti), molybdenum (Mo) and tungsten (W) or an alloy comprised mainly of the above-mentioned element, or an alloy film (typically, an Mo-W alloy film or an Mo-Ta alloy film) comprised of a combination of the above-mentioned elements, while the conductive layer (A) 6021 is formed of a tantalum nitride (TaN) film, a tungsten nitride (WN) film, a titanium nitride (TiN) film, or a molybdenum nitride (MoN) film. Further, as the substitute materials of the conductive film (A) 6021, tungsten silicide, titanium silicide, and molybdenum silicide may also be applied. The conductive layer (B) 6022 may preferably have its impurity concentration reduced in order to decrease the resistance thereof; in particular, as for the oxygen concentration, the concentration may be set to 30 ppm or less. For example, tungsten (W) could result in realizing a resistivity of 20 $\mu\Omega$cm or less by rendering the oxygen concentration thereof to 30 ppm or less.

The conductive layer (A) 6021 may be set to 10 to 50 nm (preferably, 20 to 30 nm), and the conductive layer (B) 6022 may be set to 200 to 400 nm (preferably, 250 to 350 nm). In this embodiment, as the conductive layer (A) 6021, a tantalum nitride film with a thickness of 50 nm is used, while, as the conductive layer (B) 6022, a Ta film with a thickness of 350 nm is used, both films being formed by sputtering. In case of performing sputtering here, if a suitable amount of Xe or Kr is added into the sputtering gas Ar, the internal stress of the film formed is alleviated, whereby the film can be prevented from peeling off. Though not shown, it is effective to form a silicon film, into which phosphorus (P) is doped, to a thickness of about 2 to 20 nm underneath the conductive layer (A) 6021. By doing so, the adhesiveness of the conductive film formed thereon can be enhanced, and at the same time, oxidation can be prevented. In addition, the alkali metal element slightly contained in the conductive film (A) or the conductive film (B) can be prevented from diffusing into the gate insulator film 6020. (FIG. 9C)

Next, resist masks 6023 to 6027 are formed, and the conductive layer (A) 6021 and the conductive layer (B) 6022 are etched together to form gate electrodes 6028 to 6031 and a capacitor wiring 6032. The gate electrodes 6028 to 6031 and the capacitor wiring 6032 are formed in such a manner that the layers 6028*a* to 6032*a* comprised of the conductive layer (A) and the layers 6028*b* to 6032*b* comprised of the conductive layer (B) are formed as one body respectively. In this case, the gate electrodes 6028 to 6030 formed in the driving circuit are formed so as to overlap the portions of the impurity regions 6017 and 6018 through the gate insulator film 6020. (FIG. 9D)

Figures 10A, 10B, 10C, 10D:
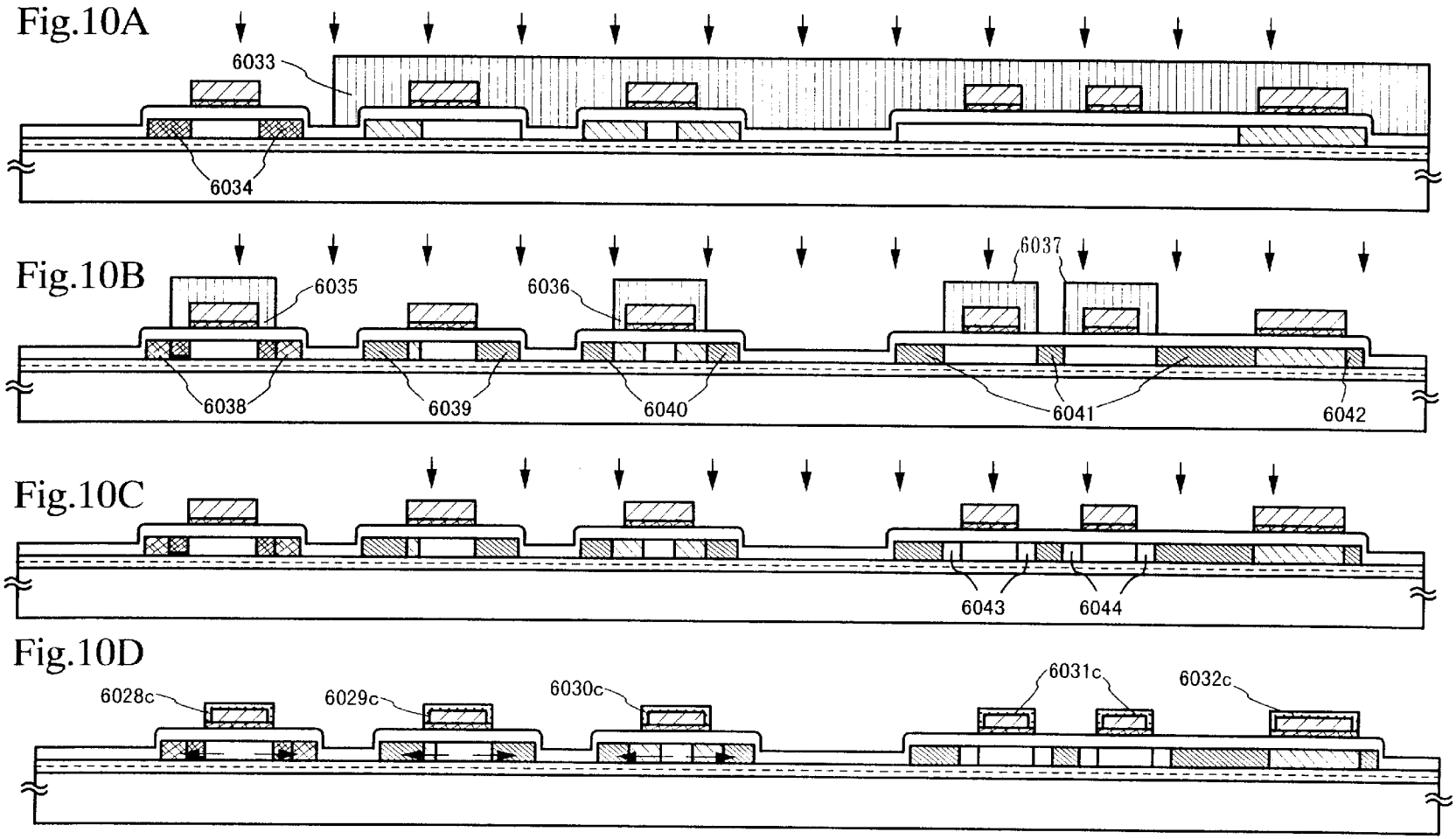
FIGS. 10A to 10D are diagrams showing an example of a process of manufacturing the liquid crystal display device employing a driver circuit according to the present invention.

Then, in order to form the source region and the drain region of the p-channel TFT in the driver, the step of adding an impurity element imparting p-type conductivity is carried out. Here, by using the gate electrode 6028 as a mask, impurity regions are formed in a self-alignment manner. In this case, the region in which the n-channel type TFT will be formed is covered with a resist mask 6033 in advance. Thus, impurity regions 6034 were formed by ion doping using diborane ($B_2H_6$). The concentration of boron (B) in this region is brought to $3\times10^{20}$ to $3\times10^{21}$ atoms/cm$^3$. In this specification, the concentration of the impurity element imparting p-type contained in the impurity regions 6034 is represented by ($p^{++}$). (FIG. 10A)

Next, in the n-channel TFTs, impurity regions that functioned as source regions or drain regions were formed. Resist masks 6035 to 6037 are formed, and impurity regions 6038 to 6042 are formed by adding an impurity element for imparting the n-type conductivity. This was carried out by ion doping using phosphine ($PH_3$), and the phosphorus (P) concentration in these regions was set to $1\times10^{20}$ to $1\times10^{21}$ atoms/cm$^3$. In this specification, the concentration of the impurity element imparting the n-type contained in the impurity regions 6038 to 6042 formed here is represented by ($n^+$). (FIG. 10B)

In the impurity regions 6038 to 6042, the phosphorus (P) or boron (B) which was added at the preceding steps are contained, however, as compared with this impurity element concentration, phosphorus is added here at a sufficiently high concentration, so that the influence by the phosphorus (P) or boron (B) added at the preceding steps need not be taken into consideration. Further, the concentration of the phosphorus (P) that is added into the impurity regions 6038 is ½ to ⅓ of the concentration of the boron (B) added at the step shown in FIG. 10A; and thus, the p-type conductivity was secured, and no influence was exerted on the characteristics of the TFTs.

Then, the step of adding an impurity imparting n-type for formation of the LDD regions of the n-channel TFT in the pixel section was carried out. Here, by using the gate electrode 6031 as a mask, the impurity element for imparting n-type is added in a self-alignment manner. The concentration of phosphorus (P) added is $1\times10^{16}$ to $5\times10^{18}$ atoms/cm$^3$; by thus adding phosphorus at a concentration lower than the concentrations of the impurity elements added at the steps shown in FIG. 9A, FIG. 10A and FIG. 10B, only impurity regions 6043 and 6044 are substantially formed. In this specification, the concentration of the impurity element for imparting the n conductivity type which impurity element is contained in these impurity regions 6043 and 6044 is represented by ($n^-$). (FIG. 10C)

Films such as a SiON film may be formed to 200 nm thickness as an interlayer film here in order to prevent peeling of Ta of the gate electrode.

Thereafter, in order to activate the impurity elements, which were added at their respective concentrations for imparting n-type or p-type conductivity, a heat treatment step is carried out. This step can be carried out by furnace annealing, laser annealing or rapid thermal annealing (RTA). The activation step is performed here by furnace annealing. Heat treatment is carried out in a nitrogen atmosphere with an oxygen concentration of 1 ppm or less, preferably 0.1 ppm or less, at 400 to 800° C., generally at 500 to 600° C.; in this embodiment, the heat treatment is carried out at 500° C. for 4 hours. Further, in the case a substrate such as a quartz substrate which has heat resistance is used as the substrate 6001, the heat treatment may be carried out at 800°

C. for one hour; in this case, the activation of the impurity elements and the junctions between the impurity regions into which the impurity element is added and the channel-forming region can be well formed. Note however that in case that the above described interlayer film for preventing peeling of Ta of the gate electrode, there are cases that this effect cannot be obtained.

By this heat treatment, on the metal films 6028*b* to 6032*b*, which form the gate electrodes 6028 to 6031 and the capacitor wiring 6032, conductive layers (C) 6028*c* to 6032*c* are formed with a thickness of 5 to 80 nm as measured from the surface. For example, in the case the conductive layers (B) 6028*b* to 6032*b* are made of tungsten (W), tungsten nitride (WN) is formed; in the case of tantalum (Ta), tantalum nitride (TaN) can be formed. Further, the conductive layers (C) 6028*c* to 6032*c* can be similarly formed by exposing the gate electrodes 6028 to 6031 and the capacitor wiring 6032 to a plasma atmosphere containing nitrogen which plasma atmosphere uses nitrogen or ammonia. Further, heat treatment is carried out in an atmosphere containing 3 to 100% of hydrogen at 300 to 450° C. for 1 to 12 hours, thus performing the step of hydrogenating the island semiconductor layers. This step is a step for terminating the dangling bonds of the semiconductor layers by the thermally excited hydrogen. As another means for the hydrogenation, plasma hydrogenation (using the hydrogen excited by plasma) may be performed.

In the case the island semiconductor layers were fabricated by the crystallization method using a catalytic element from an amorphous silicon film, a trace amount of the catalytic element remained in the island semiconductor layers. Of course, it is possible to complete the TFT even in such a state however, it was more preferable to remove the residual catalytic element at least from the channel-forming region. As one of the means for removing this catalytic element, there is the means utilizing the gettering function of phosphorus (P). The concentration of phosphorus (P) necessary to perform gettering is at the same level as that of the impurity region ($n^+$) which was formed at the step shown in FIG. 10B; by the heat treatment at the activation step carried out here, the catalytic element could be gettered from the channel-forming region of the n-channel type and the p-channel type TFTs. (FIG. 10D)

A first interlayer insulating film 6045 is formed with a thickness between 500 and 1500 nm from a silicon oxide film or a silicon oxynitiride film, contact holes reaching the source region or the drain region formed in the respective island semiconductor layers are formed and source wirings 6046 to 6049 and the drain wirings 6050 to 6053 are formed. (FIG. 11A) Though not shown in the figure, this electrode is formed from a laminated film of 3 layered structure in which a Ti film of 100 nm, an aluminum film containing Ti of 500 nm and a Ti film of 150 nm are formed successively by sputtering in this Embodiment.

Figure 11A:
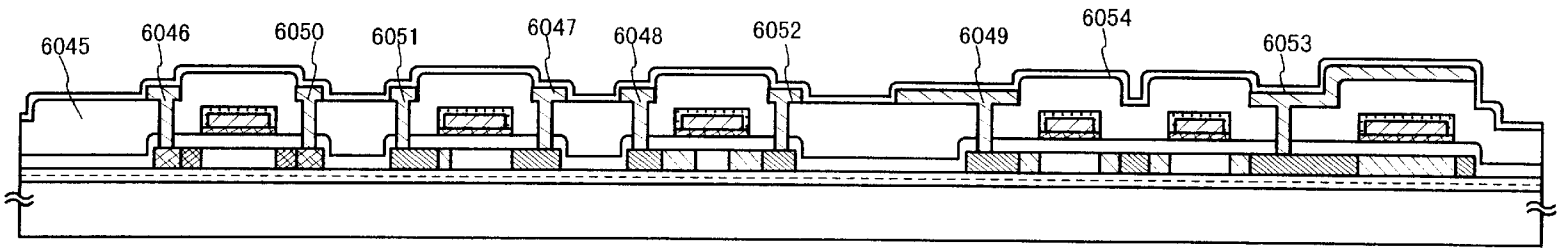
FIGS. 11A to 11B are diagrams showing an example of a process of manufacturing the liquid crystal display device employing a driver circuit according to the present invention.

Next, as a passivation film 6054, a silicon nitride film, a silicon oxide film or a silicon oxynitride film is formed to a thickness of 50 to 500 nm (typically, 100 to 300 nm). In this Embodiment the passivation film 6054 is a laminated film of 50 nm silicon nitride film and 24.5 nm silicon oxide film. When a hydrogenating treatment is carried out in this state, a desirable result was obtained in respect of the enhancement in characteristics of the TFTs. For example, it is preferable to carry out heat treatment in an atmosphere containing 3 to 100% of hydrogen at 300 to 450° C. for 1 to 12 hours; or, a similar effect was obtained when the plasma hydrogenation method is employed. Here, openings may be formed in the passivation film 6054 at the positions at which contact holes for connecting the pixel electrodes and drain wirings to each other will be formed later. (FIG. 11A)

Figure 11B:
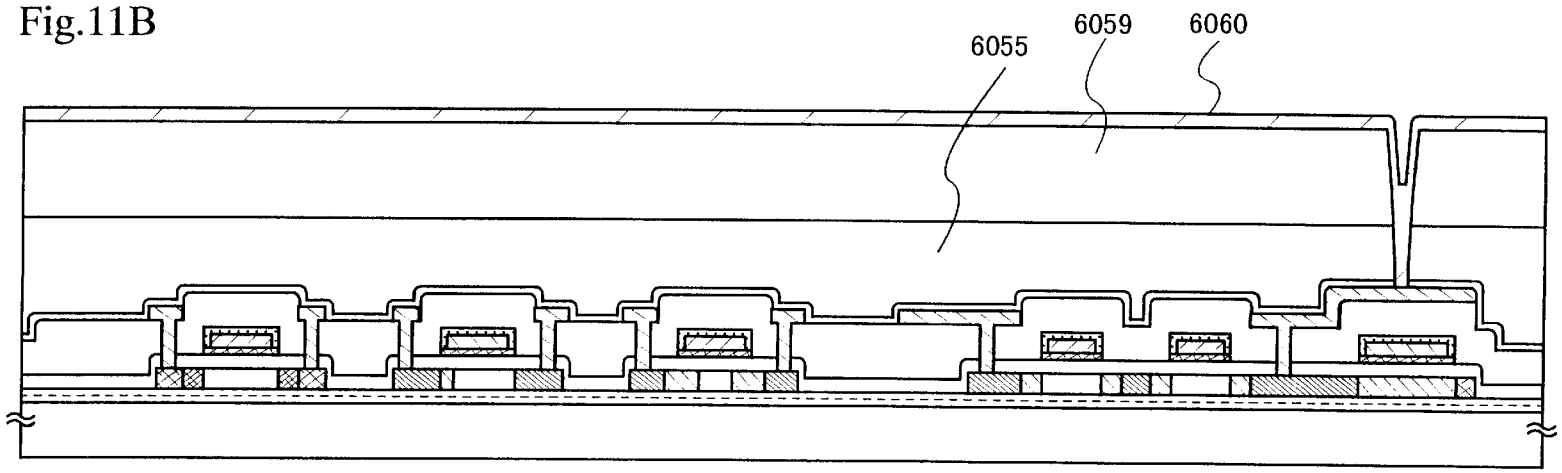

Thereafter, a second interlayer insulating film 6055 comprised of an organic resin is formed to a thickness of 1.0 to 1.5 μm. As the organic resin, polyimide, acrylic, polyamide, polyimideamide, or BCB (benzocyclobutene), etc., can be used. Here, acrylic of the type that, after applied to the substrate, thermally polymerizes is used; it is fired at 250° C., whereby the film is formed. (FIG. 11B)

A capacitance of a D/A converter circuit is formed here. The electrode which becomes an electrode of the capacitance of the D/A converter circuit is formed on the same wiring layer as the drain wiring. The second interlayer insulating film 6055 above the said electrode is entirely removed (not shown). A black matrix is formed next (not shown). The black matrix in this Embodiment is a laminate structure in which a Ti film is formed to 100 nm and an alloy film of Al and Ti is formed thereafter to 300 nm. Accordingly a capacitance of the D/A converter circuit is formed between the said electrode and the black matrix in this Embodiment.

Thereafter a third interlayer insulating film 6059 comprising organic resin is formed into 1.0 to 1.5 μm thickness. A resin similar to that of the second interlayer insulating film can be used as the organic resin. A polyimide of the type that thermally polymerizes after applying onto the substrate is used here and the film is formed by firing at 300° C.

Contact holes reaching the drain wiring 6053 is formed in the second interlayer insulating film 6055 and the third interlayer insulating film 6059 and a pixel electrode 6060 is formed. A transparent conductive film such as ITO, etc., is used as the pixel electrode 6060 in the transmission type liquid crystal display device of the invention. (FIG. 11B)

In this way, a substrate having the TFTs of the driving circuit and the pixel TFTs of the pixel section on the same substrate can be completed. In the driving circuit, there are formed a p-channel TFT 6101, a first n-channel TFT 6102 and a second n-channel TFT 6103, while, in the pixel section, there are formed a pixel TFT 6104 and a storage capacitor 6105. (FIG. 12) In this specification, such a substrate is called active matrix substrate for convenience.

A process for manufacturing a transmission type liquid crystal display device from the active matrix substrate manufactured in accordance with the above processes is next described.

Figure 12:
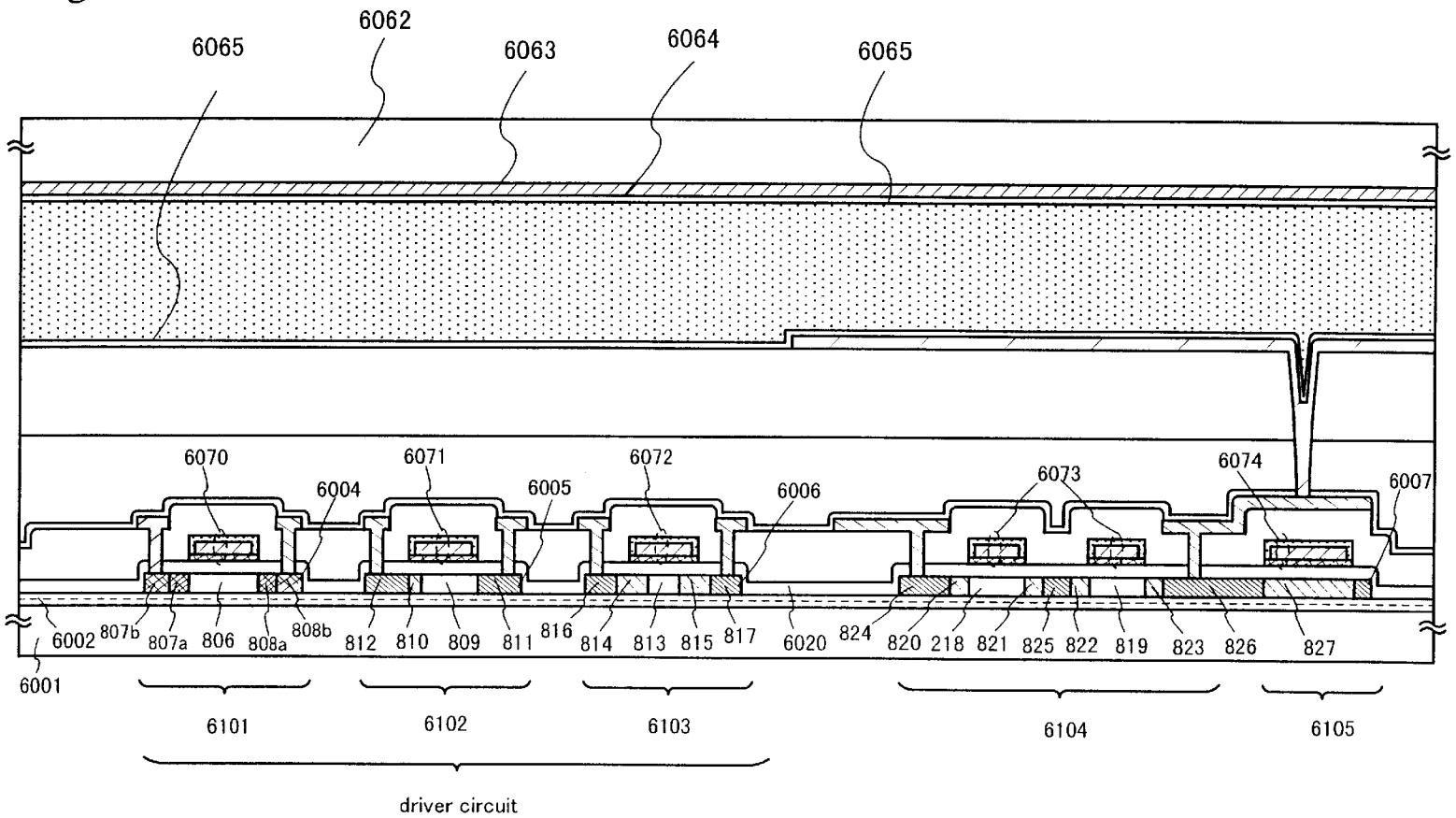
FIG. 12 is a diagram showing an example of a process of manufacturing the liquid crystal display device employing a driver circuit according to the present invention.

An alignment film 6061 is formed on the active matrix substrate of the state shown in FIG. 12. Polyimide was used in this Embodiment as the alignment film 6060. An opposing substrate is next prepared. The opposing substrate comprises a glass substrate 6062, an opposing electrode 6063 comprising a transparent conductive film and an alignment film 6064.

Note that a polyimide film is used for the alignment film in this Embodiment so as to make the liquid crystal molecules orient in parallel with respect to the substrate. The liquid crystal molecules are made to orient in parallel to have a certain pre-tilt angle by performing rubbing treatment after forming the alignment film.

The active matrix substrate which has gone through the above processes and the opposing substrate are next stuck together through a sealant or spacers (neither shown in the figure) by a known cell assembly process. Thereafter, liquid crystal 6065 is injected between the two substrates and completely sealed by a sealant (not shown). A transmission type liquid crystal display device as shown in FIG. 12 is thus complete.

Note that the transmission type liquid crystal display device is made to perform display by TN (twist) mode in this Embodiment. Accordingly the polarizing plate (not shown) is arranged on top of the transmission type liquid crystal display device.

The p-channel TFT 6101 in the driving circuit has a channel-forming region 806, source regions 807*a* and 807*b* and drain regions 808*a* and 808*b* in the island semiconductor layer 6004. The first n-channel TFT 6102 has a channel-forming region 809, an LDD region 810 overlapping the gate electrode 6071 (such an LDD region will hereinafter be referred to as Lov), a source region 811 and a drain region 812 in the island semiconductor layer 6005. The length in the channel direction of this Lov region is set to 0.5 to 3.0 μm, preferably 1.0 to 1.5 μm. A second n-channel TFT 6103 has a channel-forming region 813, LDD regions 814 and 815, a source region 816 and a drain region 817 in the island semiconductor layer 6006. As these LDD regions, there are formed an Lov region and an LDD region which does not overlap the gate electrode 6072 (such an LDD region will hereafter be referred as Loff); and the length in the channel direction of this Loff region is 0.3 to 2.0 μm, preferably 0.5 to 1.5 μm. The pixel TFT 6104 has channel-forming regions 818 and 819, Loff regions 820 to 823, and source or drain regions 824 to 826 in the island semiconductor layer 6007. The length in the channel direction of the Loff regions is 0.5 to 3.0 μm, preferably 1.5 to 2.5 μm. An offset region (not shown) is formed between the channel forming regions 818 and 819 of the pixel TFT and the Loff regions 820 to 823 which are LDD regions of the pixel TFT. Further, the storage capacitor 805 is comprised of capacitor wiring 6074, an insulator film composed of the same material as the gate insulator film 6020 and a semiconductor layer 827 which is connected to the drain region 826 of the pixel TFT 6073 and in which an impurity element for imparting the n conductivity type is added. In FIG. 12, the pixel TFT 804 is of the double gate structure, but may be of the single gate structure, or may be of a multi-gate structure in which a plurality of gate electrodes are provided.

As described above the structures of the TFTs that constitute each circuit are optimized in correspondence to the specifications required by the pixel TFT and the driver in this Embodiment thereby making the improvement in the operation performance and the reliability of the liquid crystal display device possible.

Note that an explanation is made in this Embodiment with respect to a transmission type liquid crystal display device. However the liquid crystal display device which can use the driver circuit of the present invention is not limited to this type, and the invention can also be used in a reflection type liquid crystal display device.

Embodiment 5

This Embodiment shows an example of forming a liquid crystal display device which has a driver circuit of the invention from a reverse staggered TFTs.

FIG. 13 is referenced. A cross sectional view of a reverse staggered n-channel TFT which constitutes a liquid crystal display device of this Embodiment is shown in FIG. 13. Note that though only one n-channel TFT is shown in FIG. 13, it is needless to say that a CMOS circuit can be formed from a p-channel TFT and an n-channel TFT. Further, it is needless to say that a pixel TFT can be formed by a similar constitution.

Figure 13A:
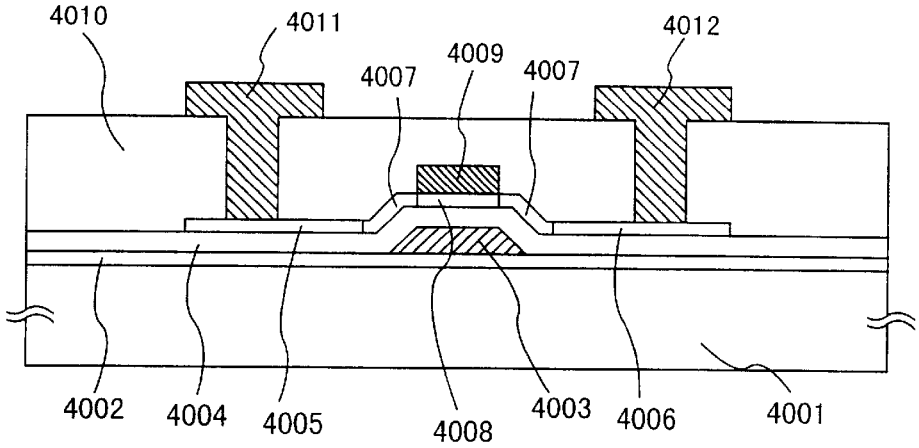
FIGS. 13A and 13B are sectional views showing the liquid crystal display device employing a driver circuit according to the present invention.

FIG. 13A is referenced. Reference numeral 4001 denotes a substrate and one that is described in Embodiment 4 can be used. Reference numeral 4002 is a silicon oxide film; 4003, a gate electrode; 4004, a gate insulating film; 4005 to 4008, active layers comprising polycrystalline silicon film. A similar method as the crystallization of amorphous silicon film described in Embodiment 4 can be used in manufacturing these active layers. Further, a method of crystallizing an amorphous silicon film by a laser beam (preferably linear laser beam or planar laser beam) may also be adopted. Note that reference numeral 4005 denotes a source region; 4006, a drain region; 4007, a low concentration impurity region (LDD region); and 4008, a channel forming region. Reference numeral 4009 is a channel protection film and 3010 is an interlayer insulating film. Reference numerals 4011 and 4012 are a source electrode and a drain electrode, respectively.

Figure 13B:
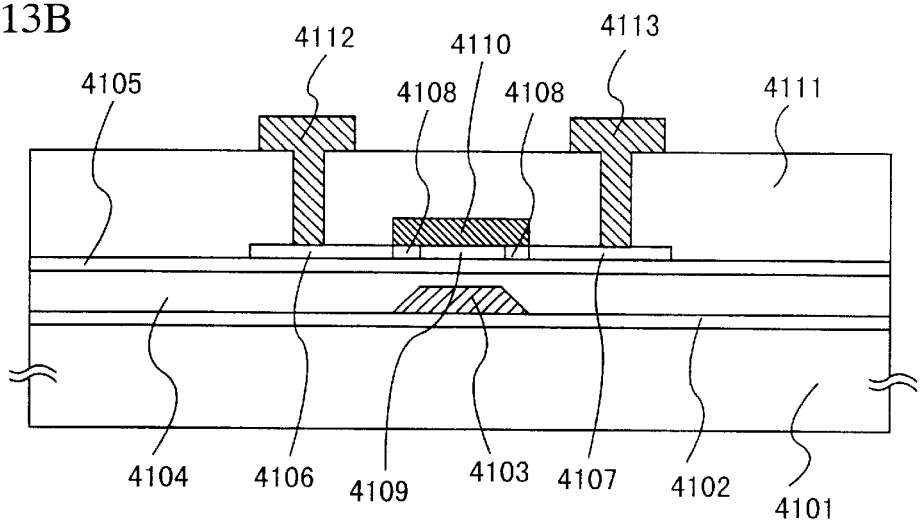

FIG. 13B is next referenced. A case of constituting a liquid crystal display device from reverse staggered TFT which differs in the structure from that of FIG. 13A is explained in FIG. 13B.

Though only one n-channel TFT is shown also in FIG. 13B, it is needless to say that a CMOS circuit can be formed from a p-channel TFT and an n-channel TFT, as described above. Further, it is needless to say that a pixel TFT can be formed from a similar structure.

Reference numeral 4101 denotes a substrate; 4102, a silicon oxide film; 4103, a gate electrode; 4104, a benzocyclobutene (BCB) film whose top surface is planarized; 4105, a silicon nitride film. A gate insulating film comprises the BCB film and the silicon nitride film. Reference numerals 4106 to 4109 denote active layers which comprise a polycrystalline silicon film. A similar method as the crystallization of amorphous silicon film described in Embodiment 1 can be used in manufacturing these active layers. Further, a method of crystallizing an amorphous silicon film by a laser beam (preferably linear laser beam or planar laser beam) may also be adopted. Note that reference numeral 4106 denotes a source region; 4107, a drain region; 4108, a low concentration impurity region (LDD region); and 4109, a channel forming region. Reference numeral 4110 is a channel protection film and 4111 is an interlayer insulating film. Reference numerals 4112 and 4113 are a source electrode and a drain electrode, respectively.

In this Embodiment because the gate insulating film formed from a BCB film and a silicon nitride film is planarized, an amorphous silicon film deposited thereon also becomes a flat one. Accordingly a more uniform polycrystalline silicon film can be obtained compared to a conventional reverse staggered TFT, in crystallizing the amorphous silicon film.

Embodiment 6

It is possible to use a variety of liquid crystal materials other than nematic liquid crystals in a liquid crystal display device which uses a driver circuit of the invention described above. For example, the liquid crystal materials disclosed in: Furue, H, et al., "Characteristics and Driving Scheme of Polymer-stabilized Monostable FLCD Exhibiting Fast Response Time and High Contrast Ratio with Gray-scale Capability," SID, 1998; in Yoshida, T., et al., "A Full-color Thresholdless Antiferroelectric LCD Exhibiting Wide Viewing Angle with Fast Response Time." SID 97 Digest, 841, 1997; S. Inui et al., "Thresholdless antiferroelectricity in Liquid Crystals and its Application to Displays", J. Mater. Chem. 6(4), 671–673, 1996; and in U.S. Pat. No. 5,594,569 can be used.

A liquid crystal that shows antiferroelectric phase in a certain temperature range is called an antiferroelectric liquid crystal. Among a mixed liquid crystal comprising antiferroelectric liquid crystal material, there is one called thresholdless antiferroelectric mixed liquid crystal that shows electro-optical response characteristic in which transmittivity is continuously varied against electric field. Among the thresholdless antiferroelectric liquid crystals, there are some that show V-shaped electro-optical response characteristic, and even liquid crystals whose driving voltage is approximately ±2.5 V (cell thickness approximately 1 μm to 2 μm) are found.

Figure 14:
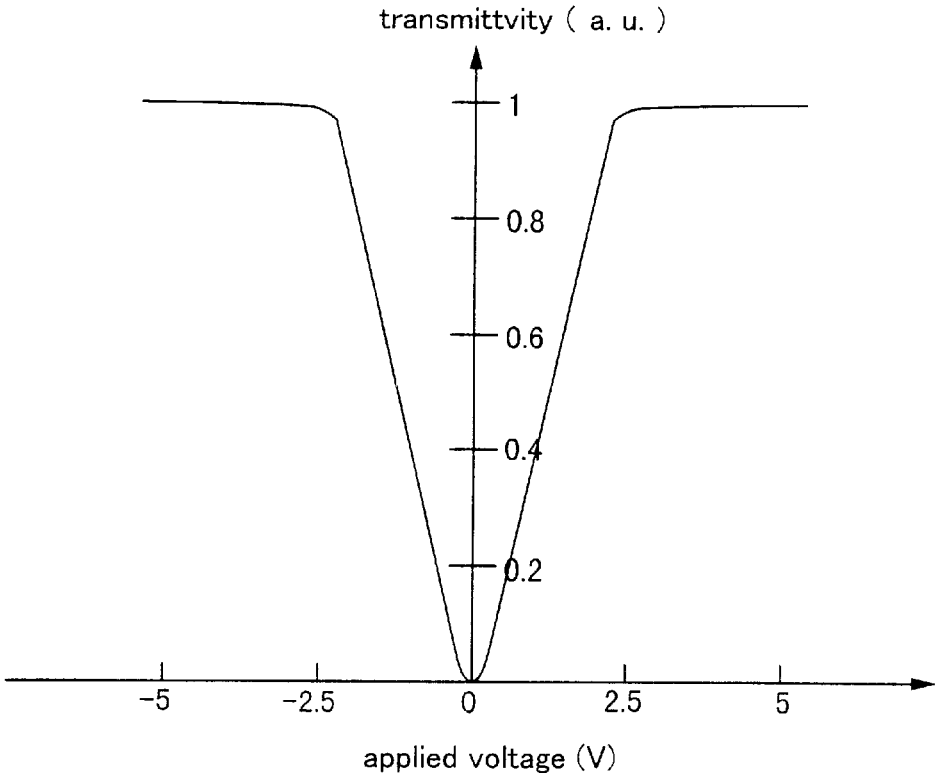
FIG. 14 is a graph showing an applied voltage-transmittance characteristic of antiferroelectric liquid crystal whose electro-optical characteristic graph forms a shape of letter V.

An example of light transmittivity characteristic against the applied voltage of thresholdless antiferroelectric mixed liquid crystal showing V-shaped electro-optical response characteristic, is shown in FIG. 14. The axis of ordinate in the graph shown in FIG. 14 is transmittivity (arbitrary unit) and the axis of the abscissas is the applied voltage. The transmitting direction of the polarizer on light incident side of the liquid crystal display is set at approximately parallel to direction of a normal line of the smectic layer of thresholdless antiferroelectric liquid crystal that approximately coincides with the rubbing direction of the liquid crystal display device. Further, the transmitting direction of the polarizer on the light radiating side is set at approximately right angles (crossed Nicols) against the transmitting direction of the polarizer on the light incident side.

As shown in FIG. 14, it is shown that low voltage driving and gray scale display is available by using such thresholdless antiferroelectric mixed liquid crystal.

Further, also in case of using the low voltage driving thresholdless antiferroelectric mixed liquid crystal to a liquid crystal display device having a driver circuit of the invention, the operation power supply voltage of the D/A converter circuit can be lowered because the output voltage of the D/A converter circuit can be lowered, and the operation power voltage of the driver can be lowered. Accordingly, low consumption electricity and high reliability of the liquid crystal panel can be attained.

Therefore the use of such low voltage driving thresholdless antiferrelectric mixed liquid crystal is effective in case of using a TFT having a relatively small LDD region (low concentration impurity region) width (for instance 0 to 500 nm, or 0 to 200 nm).

Further, thresholdless antiferroelectric mixed liquid crystal has large spontaneous polarization in general, and the dielectric constant of the liquid crystal itself is large. Therefore, comparatively large storage capacitor is required in the pixel in case of using thresholdless antiferroelectric mixed liquid crystal for a liquid crystal display device. It is therefore preferable to use thresholdless antiferroelectric mixed liquid crystal having small spontaneous polarity.

A low consumption electricity of a liquid crystal display device is attained because low voltage driving is realized by the use of such thresholdless antiferroelectric mixed liquid crystal.

Note that any of the liquid crystals can be used as a display medium of the liquid crystal display device which uses a driver circuit of the invention provided that the liquid crystal has an electro-optical characteristic as shown in FIG. 14.

Embodiment 7

A liquid crystal display device having a driver circuit of the invention can be used by incorporating onto various electronic appliances.

The following can be given as examples of this type of electronic appliances: video cameras; digital cameras; projectors (rear type or front type); head mounted displays (goggle type display); game machines; car navigation systems; personal computers; portable information terminals (such as mobile computers, portable telephones and electronic notebook). Some examples of these are shown in FIGS. 15A and 15B and 16A to 16F.

Figure 15A:
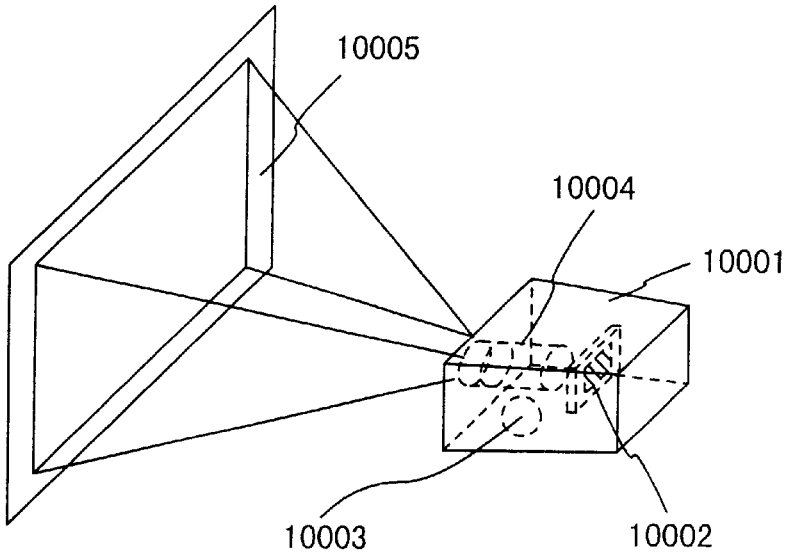
FIGS. 15A and 15B are diagrams showing examples of electronic equipment having incorporated therein a liquid crystal display device employing a driver circuit of the present invention.

FIG. 15A is a front type projector, which comprises a main body 10001, a liquid crystal display device 10002 which uses a driver circuit of the present invention, a light source 10003, an optical system 10004 and a screen 10005. Note that though a front projector which incorporates one liquid crystal display device is shown in FIG. 15A, a higher resolution and higher precision front projector can be realized by incorporating 3 liquid crystal display devices (corresponding to the lights of R, G and B respectively).

Figure 15B:
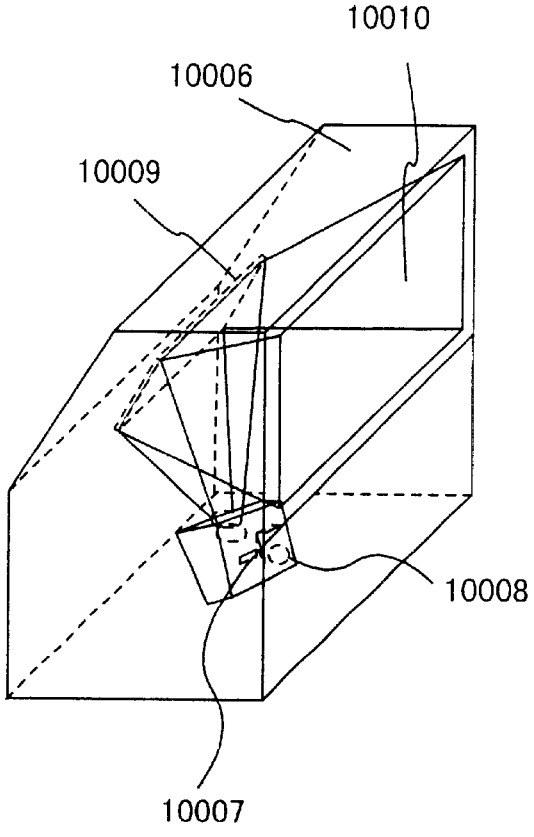

FIG. 15B is a rear type projector, which comprises: a main body 10006; a liquid crystal display device 10007 which uses a driver circuit of the invention; a light source 10008; a reflector 10009 and a screen 10010. A rear projector which incorporates 3 liquid crystal display devices (corresponding to the lights of R, G and B respectively) is shown in FIG. 15B.

Figure 16A:
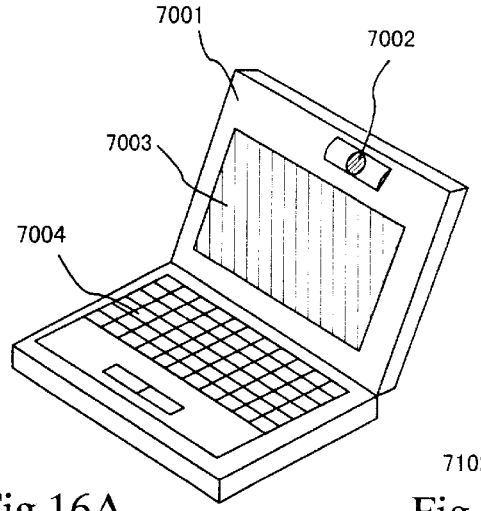
FIGS. 16A to 16F are diagrams showing examples of electronic equipment having incorporated therein a liquid crystal display device employing a driver circuit of the present invention.

FIG. 16A is a personal computer, which comprises: a main body 7001; an image input section 7002; a liquid crystal display device which uses a driver circuit of the invention 7003; and a keyboard 7004.

Figure 16B:
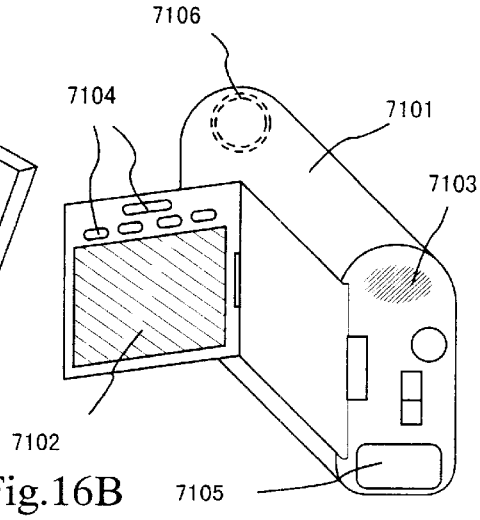

FIG. 16B is a video camera, which comprises a main body 7101; a liquid crystal display device which uses a driver circuit of the invention 7102; a voice input section 7103; operation switches 7104; a battery 7105; and an image receiving section 7106.

Figure 16C:
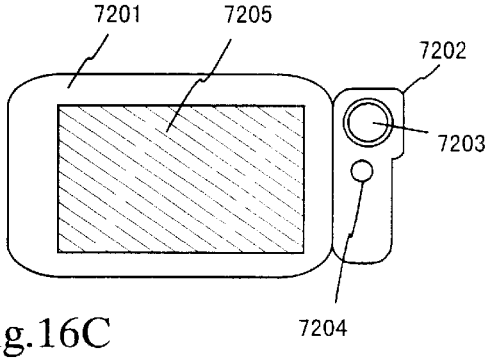

FIG. 16C is a mobile computer, which comprises: a main body 7201; a camera section 7202; an image receiving section 7203; operation switches 7204; and a liquid crystal display device 7205 which uses a driver circuit of the invention.

Figure 16D:
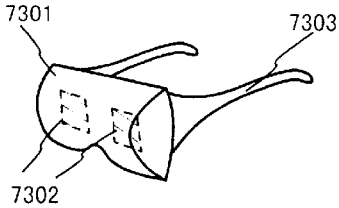

FIG. 16D is a goggle type display, which comprises a main body 7301; liquid crystal display devices which use a driver circuit of the invention 7302 ; and arm sections 2303.

Figure 16E:
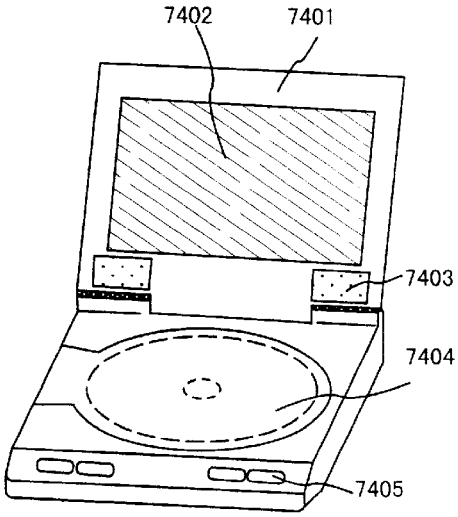

FIG. 16E is a player that uses a recording medium on which a program is recorded (hereinafter referred to as a recording medium), which comprises: a main body 7401; a liquid crystal display device 7402 which uses a driver circuit of the invention; a speaker section 7403; a recording medium 7404; and operation switches 7405. Note that music appreciation, film appreciation, games, and the use of the Internet can be performed with this device using a DVD (digital versatile disk), a CD, etc., as a recording medium.

Figure 16F:
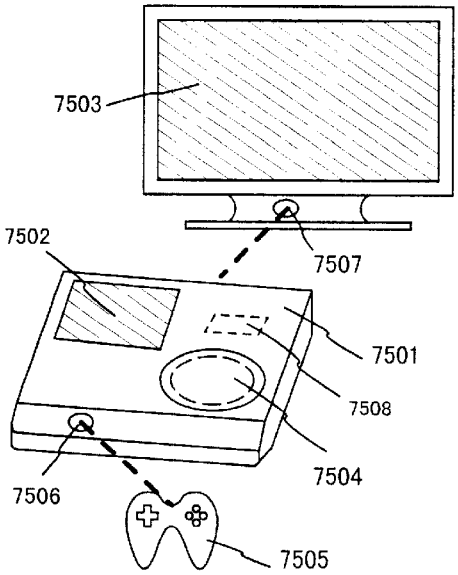
Figure 17:
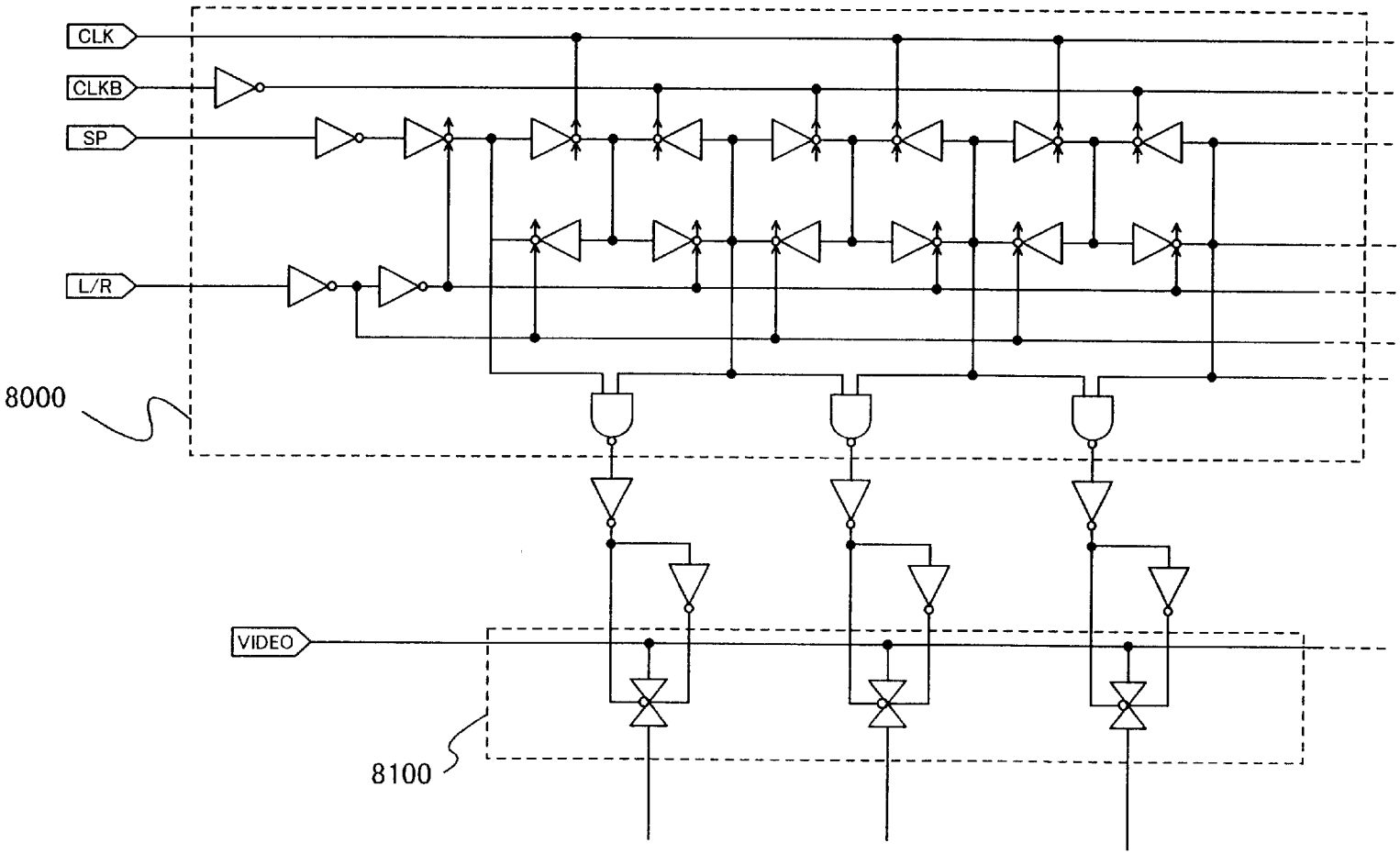
FIG. 17 is a circuit diagram showing a configuration of a conventional driver circuit.

FIG. 16F is a game machine, which comprises a main body 7501, a liquid crystal display device which uses a driver circuit of the invention 7502, a display device 7503, a recording medium 7504, a controller 7505, a main body sensor unit 7506, a sensor unit 7507 and a CPU unit 7508. The main body sensor unit 7506 and the sensor unit 7507 are capable of sensing infrared rays emitted from the controller 7505 and the main body 7501 respectively.

As described above, the applicable range of the liquid crystal display device which uses a driver circuit of the invention is very large, and can be applied to electronic appliances of various fields.

A driver circuit of the present invention has a construction which is more simplified and half or less than half elements compared to a conventional driver circuit. Therefore, the production yield in the liquid crystal display device employing the driver circuit of the present invention becomes better and small scale liquid crystal display devices can be manufactured.

What is claimed is:

1. A driver circuit for a display device comprising:

a shift register circuit having a plurality of register circuits including a clocked inverter circuit and an inverter circuit connected in series;

a plurality of digital data latch circuits having a first N-channel transistor and a second N-channel transistor in which the sources or drains are connected in series, a P-channel transistor, and a digital data holding circuit, wherein:

said clocked inverter circuit and said inverter circuit generate a timing signal on the basis of a clock signal, a clock back signal, and a start pulse inputted from outside, and feeds the timing signal to a register circuit neighboring said register circuit and a gate electrode of said second N-channel transistor;

said P-channel transistor inputs a first electric current voltage to said digital data holding circuit in accordance with a reset signal that is inputted from outside to a gate electrode of the P-channel transistor;

said first N-channel transistor takes in digital data inputted on the basis of said timing signal and feeds the digital data to the source or the drain of the second N-channel transistor; and the timing signal outputted from a register circuit neighboring said register circuit is fed to a gate electrode of said first N-channel transistor.

2. A driver circuit for a display device according to claim 1, wherein the digital data holding circuit has two inverter circuits.

3. A driver circuit for a display device according to claim 1, wherein the digital data holding circuit has a capacitance.

4. Electronic equipment comprising a display device according to claim 1 is selected from the group consisting of a projector, rear projector, front projector, goggle type display, mobile computer, notebook personal computer, video camera, DVD player, and game machine.

5. A driver circuit for a display device comprising:

a shift register circuit having a register circuit including a clocked inverter circuit and an inverter circuit connected in series;

a digital data latch circuit having a first N-channel transistor and a second N-channel transistor in which the sources or drains are connected in series, a P-channel transistor, and a digital data holding circuit, wherein:

a gate electrode of said second N-channel transistor is connected to the output line of said register circuit, a source or a drain of said second N-channel transistor is connected to a source or a drain of said first N-channel transistor, and the other end of the source or the drain of the said second N-channel transistor is connected to said digital data holding circuit;

a gate electrode of said first N-channel transistor is connected to the output line of a register circuit neighboring said register circuit and the other end of the source or the drain of said first N-channel transistor is connected to a signal line to which digital data are inputted; and a gate electrode of said P-channel transistor is connected to a signal line to which a reset signal is inputted and one end of a source or a drain of said P-channel transistor is connected to a first power source whereas the other end of the source or the drain of the P-channel transistor is connected to said digital data holding circuit.

6. A driver circuit for a display device according to claim 5, wherein the digital data holding circuit has two inverter circuits.

7. A driver circuit for a display device according to claim 5, wherein the digital data holding circuit has a capacitance.

8. Electronic equipment comprising a display device according to claim 5 is selected from the group consisting of a projector, rear projector, front projector, goggle type display, mobile computer, notebook personal computer, video camera, DVD player, and game machine.

9. A driver circuit for a display device comprising:

a shift register circuit having a plurality of register circuits including a clocked inverter circuit and an inverter circuit connected in series;

a plurality of digital data latch circuits having a first P-channel transistor and a second P-channel transistor in which the sources or drains are connected in series, an N-channel transistor, and a digital data holding circuit, wherein:

said clocked inverter circuit and said inverter circuit generate a timing signal on the basis of a clock signal, a clock back signal, and a start pulse inputted from outside and feeds the timing signal to a register circuit neighboring said register circuit and to a gate electrode of said second P-channel transistor;

said N-channel transistor feeds a second electric current voltage to said digital data holding circuit in accordance with a reset signal that is inputted from outside to a gate electrode of said N-channel transistor;

said first P-channel transistor takes in digital data inputted on the basis of said timing signal and feeds the digital data to the source or the drain of said second P-channel transistor; and the timing signal outputted from a register circuit neighboring said register circuit is fed to a gate electrode of said first P-channel transistor.

10. A driver circuit for a display device according to claim 9, wherein the digital data holding circuit has two inverter circuits.

11. A driver circuit for a display device according to claim 9, wherein the digital data holding circuit has a capacitance.

12. Electronic equipment comprising a display device according to claim 9 is selected from the group consisting of a projector, rear projector, front projector, goggle type display, mobile computer, notebook personal computer, video camera, DVD player, and game machine.

13. A driver circuit for a display device comprising:

a shift register circuit having a register circuit including a clocked inverter circuit and an inverter circuit connected in series;

a digital data latch circuit having a first P-channel transistor and a second P-channel transistor in which the sources or drains are connected in series, an N-channel transistor, and a digital data holding circuit, wherein:

a gate electrode of said second P-channel transistor is connected to the output line of said register circuit, a source or a drain of said second P-channel transistor is connected to a source or a drain of said first P-channel transistor, and the other end of the source or the drain of the said second P-channel transistor is connected to said digital data holding circuit;

a gate electrode of said first P-channel transistor is connected to the output line of a register circuit neighboring said register circuit and the other end of the source or the drain of said first P-channel transistor is connected to a signal line to which digital data are inputted; and a gate electrode of said N-channel transistor is connected to a signal line to which a reset signal is inputted and one end of a source or a drain of said N-channel transistor is connected to a second power source whereas the other end of the source or the drain of the N-channel transistor is connected to said digital data holding circuit.

14. A driver circuit for a display device according to claim 13, wherein the digital data holding circuit has two inverter circuits.

15. A driver circuit for a display device according to claim 13, wherein the digital data holding circuit has a capacitance.

16. Electronic equipment comprising a display device according to claim 13 is selected from the group consisting of a projector, rear projector, front projector, goggle type display, mobile computer, notebook personal computer, video camera, DVD player, and game machine.

* * * * *